US012036434B2

(12) United States Patent
Kelly

(10) Patent No.: US 12,036,434 B2
(45) Date of Patent: Jul. 16, 2024

(54) ADJUSTABLE EXERCISE EQUIPMENT

(71) Applicant: Francis Noble Kelly, Vancouver (CA)

(72) Inventor: Francis Noble Kelly, Vancouver (CA)

( * ) Notice: Subject to any disclaimer, the term of this patent is extended or adjusted under 35 U.S.C. 154(b) by 208 days.

(21) Appl. No.: 17/860,975

(22) Filed: Jul. 8, 2022

(65) Prior Publication Data

US 2023/0009261 A1 Jan. 12, 2023

Related U.S. Application Data

(60) Provisional application No. 63/220,906, filed on Jul. 12, 2021.

(51) Int. Cl.
*A63B 21/062* (2006.01)
*A63B 21/00* (2006.01)

(52) U.S. Cl.
CPC ..... *A63B 21/063* (2015.10); *A63B 21/156* (2013.01); *A63B 21/4033* (2015.10); *A63B 2225/102* (2013.01)

(58) Field of Classification Search
CPC ... A63B 21/063; A63B 21/151; A63B 21/153; A63B 21/154; A63B 21/155; A63B 21/156; A63B 21/159; A63B 21/1681; A63B 21/4033
See application file for complete search history.

(56) References Cited

U.S. PATENT DOCUMENTS 4,199,139 A * 4/1980 Mahnke ..... A63B 21/0632 482/101
4,402,504 A * 9/1983 Christian ..... A63B 21/156 482/129
4,470,596 A * 9/1984 Desiderio ..... A63B 21/0628 482/99
4,549,733 A * 10/1985 Salyer ..... A63B 23/03525 482/133
4,763,897 A 8/1988 Yakata
4,898,381 A 2/1990 Gordon
5,181,896 A 1/1993 Jones
5,316,535 A 5/1994 Bradbury
5,486,150 A 1/1996 Randolph
5,554,085 A 9/1996 Dalebout
5,570,957 A 11/1996 Kuly et al.
5,580,341 A 12/1996 Simonson
(Continued)

FOREIGN PATENT DOCUMENTS

WO 9306893 A1 4/1993

*Primary Examiner* — Zachary T Moore
(74) *Attorney, Agent, or Firm* — Oyen Wiggs Green & Mutala LLP

(57) ABSTRACT

A resistance training machine comprises a carriage with a handle coupled to move along a linear guide such as a post. First and second end portions of a flexible element are respectively coupled the carriage. A portion of the flexible element forms a loop defined by a series of guiding elements such as pulleys. The loop is coupled to a resistance element such as a weight. First and second fasteners are respectively provided in the first and second end portions of the flexible element. A user can adjust the carriage to a starting position at their desired height and affix one of the fasteners to an anchor point of the receivers. The user can move the carriage either through causing the loop of the flexible element to be reduced in length and to pull on the resistance element or plates on plate horns to perform resistance training.

19 Claims, 23 Drawing Sheets

(56) References Cited

U.S. PATENT DOCUMENTS

| | | | | |
|---|---|---|---|---|
| 5,725,459 | A | 3/1998 | Rexach | |
| 5,842,961 | A | 12/1998 | Davis | |
| 5,971,897 | A | 10/1999 | Olson et al. | |
| 6,238,323 | B1 | 5/2001 | Simonson | |
| 6,315,702 | B1 | 11/2001 | Ikonomopoulos | |
| 6,447,430 | B1 | 9/2002 | Webb et al. | |
| 6,527,683 | B2 | 3/2003 | Tolles | |
| 6,770,015 | B2 | 8/2004 | Simonson | |
| 6,905,446 | B2 | 6/2005 | Greenland | |
| 7,014,599 | B2 | 3/2006 | Ashley | |
| 7,172,538 | B2 | 2/2007 | Keiser | |
| 7,553,264 | B2 | 6/2009 | Carter | |
| 7,651,443 | B1 * | 1/2010 | Fenster | A63B 71/0036 482/37 |
| 7,874,965 | B2 | 1/2011 | Alessandri et al. | |
| 7,918,771 | B2 | 4/2011 | Rogers et al. | |
| 7,922,632 | B2 | 4/2011 | Chou | |
| 8,152,702 | B2 | 4/2012 | Pacheco | |
| 8,500,608 | B1 | 8/2013 | Bonomi | |
| 8,529,408 | B2 | 9/2013 | Bell et al. | |
| 8,926,480 | B2 | 1/2015 | Lyszczarz | |
| 9,050,496 | B2 | 10/2015 | Towley, III et al. | |
| 9,314,659 | B2 * | 4/2016 | Gvoich | A63B 23/03541 |
| 9,403,047 | B2 | 8/2016 | Olson et al. | |
| 9,802,075 | B2 | 10/2017 | Gvoich | |
| 9,968,819 | B2 | 5/2018 | Hockridge | |
| 10,238,917 | B1 | 3/2019 | Kojayan | |
| 10,695,602 | B2 | 6/2020 | Gore | |
| 10,744,365 | B2 * | 8/2020 | Kuo | A63B 21/4033 |
| 10,940,357 | B2 | 3/2021 | Hansen et al. | |
| 11,819,727 | B2 * | 11/2023 | Robinson | A63B 23/03525 |
| 2002/0193213 | A1 | 12/2002 | Batca et al. | |
| 2006/0264304 | A1 | 11/2006 | Habing | |
| 2007/0093365 | A1 * | 4/2007 | Batca | A63B 21/154 482/99 |
| 2013/0065737 | A1 * | 3/2013 | Habing | A63B 21/0628 482/102 |
| 2013/0274075 | A1 * | 10/2013 | Habing | A63B 21/0628 482/102 |
| 2018/0200563 | A1 * | 7/2018 | Hansen | F16B 21/09 |
| 2022/0054878 | A1 * | 2/2022 | Thach | A63B 21/156 |
| 2023/0024013 | A1 * | 1/2023 | Horn | A63B 21/015 |

* cited by examiner

ADJUSTABLE EXERCISE EQUIPMENT

TECHNICAL FIELD

This invention relates to exercise equipment, specifically resistance training machines.

BACKGROUND

Resistance training machines are exercise machines that apply resistance to a user's movements. A weight lifting machine is a resistance training machine in which the resistance arises from lifting a weight. Resistance training machines of various types are often found in gyms. The use of resistance training machines (including weight lifting machines) requires proper form to avoid injuries. Proper form can be achieved through practice and technique, but it is also critical that the resistance training machine is properly sized for the user. Resistance training machines should be adjustable to accommodate individuals of different physical proportions. It can also be desirable to adjust resistance training machines for use in different types of exercises. It is desirable that resistance training machines are quickly and easily adjustable. This is especially important for resistance training machines in public gyms, as different people of different sizes may use the same resistance training machine in rotation.

There is therefore a general desire to have highly adjustable resistance training machines to accommodate individuals of different sizes. This would improve ergonomics for the users of resistance training machines.

SUMMARY

This invention has various aspects. These include, without limitation: resistance training machines; methods for resistance training; and handles useful in resistance training.

One aspect of the invention provides a resistance training machine. The resistance training machine comprises: a resistance mechanism, the resistance mechanism comprising: a carriage coupled to move along a linear guide (e.g. a post), an elongated flexible element having first and second end portions coupled to the carriage, first and second fasteners that respectively include first and second stoppers attached to the first and second end portions of the flexible element respectively, each of the first and second fasteners adapted to be attached to one of a plurality of anchor points that are fixed relative to the linear guide. A portion of the flexible element between the first and second end portions forms a loop that follows a path defined by a plurality of guide elements (e.g. pulleys), the guide elements include a displaceable guide element, such as a displaceable pulley, coupled to a resistance element. Moving the carriage along the linear guide while one of the first and second fasteners is coupled to one of the anchor points causes the length of the portion of the flexible element that forms the loop to be reduced, thereby displacing the displaceable guide element against a force applied by the resistance element.

In some embodiments the first and second end portions of the flexible element double back around first and second rollers carried on the carriage. In some such embodiments the first and second end portions of the flexible element may respectively double back through first and second openings provided in the carriage.

In some such embodiments the first and second end portions of the flexible element may respectively pass through the first and second openings provided in the carriage.

In some such embodiments the first end portion of the flexible element may be fixed to the carriage and the second end portion of the flexible element may double back through the opening or pass through the other opening provided in the carriage.

In some embodiments the linear guide comprises a post, and the carriage is coupled to slidably move along the post.

In some embodiments the post provides a plurality of receivers spaced along the post, and the first and second fasteners are each attachable to the receivers, and each of the plurality of receivers may be used as the anchor point.

In some embodiments the post additionally or alternatively provides a plurality of pin holes for locking the carriage in place onto the post.

In some embodiments the carriage is formed with a through passage and the post extends through the through passage of the carriage. The post may, for example have a square cross section. The carriage and the post may have the same cross section shape.

In some embodiments the carriage comprises plural bearings arranged to roll along the post.

In some embodiments The flexible element is selected from the group consisting of: a cable, a wire, a cord, a band, a strap, a chain, and a cable.

In some embodiments the resistance element comprises a weight that is raised by reduction of the length of the portion of the flexible element that forms the loop. For example, the weight may hang from a displaceable pulley. The path of the flexible element may include a bight that extends between two of the guide elements and passes around the displaceable pulley. In alternative embodiments the resistance element may comprise an elastically flexible rod, resistance tubes and bands, an electric motor(s), a magnetic resistance element, a pneumatic piston, a spring etc.

A handle may be attached to move with the carriage. The handle may be detachably affixed to the carriage.

In some embodiments the handle comprises: a base affixed to the carriage that supports an arc shaped segment in a first plane orthogonal to the linear guide, a convex side of the arc shaped segment facing the linear guide; a pair of handgrips affixed to each end of the arc shaped segment, each of the pairs of hand grips arranged to form an obtuse angle in the first plane, wherein the obtuse angles face away from the linear guide; and a crossbar affixed to opposite ends of the arc shaped segment, the crossbar lying in a second plane above and parallel to the first plane. The crossbar is optionally split into two parts, the two parts each hingedly affixed to the handle such that the two parts hinge in the direction of gravity when not in use, and form a solid bar against which to press against when moving the bar in a direction opposite to gravity. Further, in some embodiments, a second hinge may allow alignment for the purpose of securing the two parts of the cross bar to the bar to prevent interference with a user, for example with clips.

In some embodiments the handle may be of a different construction. For example, the handle could comprise any one of a cannonball grip, a nunchuck grip, a stirrup handle, a dog bone grip, a seated row handle, a tricep handle, a revolving straight bar, a revolving curl bar, a V-bar, a platform with a bar, a triceps rope, and an ankle strap.

In some embodiments the handle comprises: a first segment coupled to the carriage; a second segment hingedly coupled to the first segment, wherein the second segment is moveable between a first configuration horizontally aligned with the first segment and a second configuration vertically and forwardly displaced with respect to the first segment; and a pair of arms pivotally coupled to the second segment, each arm comprising at least one handgrip. Each of the arms may comprise a distal portion and a proximal portion with a pivot point with the second segment therebetween, wherein the distal portions and the second segment are in the same plane, and wherein the proximal portions are in a different parallel plane, further comprising tension cables attached between opposing one of the distal and proximal portions in a cross-wise manner.

In some embodiments an isometric stopper pivotally may be coupled to carriages with handles, the isometric stopper comprising an engaging portion engageable with corresponding receiving means on the linear guide to prevent further linear displacement of the carriage along the linear guide, wherein the isometric stopper is manually actuatable by an actuating means.

The linear guide my be vertical. In some embodiments, the linear guide is inclined at an angle to vertical. The angle to vertical is optionally adjustable.

In some embodiments the resistance training machine comprises a second carriage that supports a platform, wherein the second carriage is positioned below the carriage attached to the handle.

In some embodiments resistance training machines as described herein comprise a first resistance mechanism and a second resistance mechanism. The first and second resistance mechanisms may, for example, be worked by a users two arms or two legs. The first and second resistance mechanisms optionally share a common resistance element (e.g. a common weight). In some embodiments carriages of the first and second resistance mechanisms are located side-by-side. In some embodiments each of the first and second resistance mechanisms have the same construction.

First and second resistance mechanisms may be coupled to a shared resistance element by respectively coupling a loop of the flexible element of the first resistance mechanism and a loop of the second resistance mechanism to a first central pulley and a second central pulley. The first and second central pulleys may be respectively coupled to a first end and a second end of a third flexible element, the third flexible element is coupled to a displaceable pulley coupled to the resistance element.

In some embodiments, a resistance element comprises: a first and second end of the carriage, the first and second end of the carriage being antipodal to each other along the linear guide; the first end portion of the flexible element may extend through or along the carriage in a first direction and the second end portion of the flexible element may extend through or along the carriage in a second direction opposed to the first direction.

Another aspect of the invention provides a resistance training machine comprising: a carriage; a handle coupled to the carriage; a flexible element having a first end in contact with the carriage and a second end in contact with the carriage; a first fastener and second fastener respectively affixed to the first and second ends of the flexible element; a resistance element coupled to the flexible element; a post having a plurality of receivers for the first and second fasteners, the carriage being coupled to the post, the first and second fastener being fastenable to receivers in the post so that moving the carriage causes the resistance element to impose a force against the carriage; wherein the resistance element comprises a weight that hangs from a pulley that is coupled with the flexible element; wherein the handle has a detachment point detachably affixing the handle to the carriage; wherein the first and second fasteners are carabiners; wherein the post and carriage have a square cross-section; wherein a wheel and/or ball bearings decrease the friction between the carriage and the post.

Another aspect of the invention provides a resistance training machine comprising: a first carriage coupled to move along a first linear guide; a second carriage coupled to move along a second linear guide; a first elongated flexible element having first and second end portions coupled to the first carriage, the first and second end portions of the first flexible element doubled back around first and second rollers carried on the first carriage; a second elongated flexible element having first and second end portions coupled to the second carriage, the first and second end portions of second flexible element doubled back around first and second rollers carried on the second carriage; first and second fasteners that respectively include first and second stoppers attached to the first and second end portions of the first flexible element respectively, each of the first and second fasteners adapted to be attached to an anchor point that is fixed relative to the first linear guide; first and second fasteners that respectively include first and second stoppers attached to the first and second end portions of the second flexible element respectively, each of the first and second fasteners adapted to be attached to an anchor point that is fixed relative to the second linear guide; wherein a portion of the first flexible element between the first and second end portions forms a first loop that follows a path defined by a plurality of pulleys, including a first displaceable central pulley; wherein a portion of the second flexible element between the first and second end portions forms a second loop that follows a path defined by a plurality of pulleys, including a second displaceable central pulley; wherein the first and second displaceable central pulley are coupled to a third flexible element coupled to a third displaceable pulley coupled to a resistance element; moving the first carriage along the first linear guide while one of the first and second fasteners is coupled to the anchor point causes the length of the portion of the first flexible element that forms the first loop to be reduced, thereby displacing the first displaceable pulley against a force applied by the resistance element; moving the second carriage along the second linear guide while one of the first and second fasteners is coupled to the anchor point causes the length of the portion of the second flexible element that forms the second loop to be reduced, thereby displacing the second displaceable pulley against a force applied by the resistance element.

Another aspect of the invention provides a resistance training machine comprising: a carriage coupled to move along a linear guide; an elongated flexible element having first and second end portions coupled to the carriage; the carriage having a first and second end, the first and second end of the carriage being antipodal to each other along the linear guide; the first end portion of the elongated flexible element being threaded through the first end of the carriage, terminating at a point on the second end of the carriage; the second end portion of the elongated flexible element being threaded through the second end of the carriage, terminating at a point on the first end of the carriage; first and second fasteners that respectively include first and second stoppers attached to the first and second end portions of the flexible element respectively, each of the first and second fasteners adapted to be attached to an anchor point that is fixed relative to the linear guide; wherein a portion of the flexible element between the first and second end portions forms a loop that follows a path defined by a plurality of pulleys; the pulleys include a displaceable pulley coupled to a resistance element; and moving the carriage along the linear guide while one of the first and second fasteners is coupled to the anchor point causes the length of the portion of the flexible element that forms the loop to be reduced, thereby displacing the one of the pulleys against a force applied by the resistance element.

Another aspect of the invention provides a handle useful for resistance training. The handle comprises a base affixed or affixable to a carriage and an arc shaped segment supported by the base. The arc shaped segment is disposed in a first plane orthogonal to the carriage. A convex side of the arc shaped segment faces the carriage. A pair of handgrips are affixed to each end of the arc shaped segment. Each of the pairs of hand grips is arranged to form at an obtuse angle in the first plane wherein the obtuse angles face away from the carriage. A crossbar is affixed to opposite ends of the arc shaped segment. The crossbar lies in a second plane above and parallel to the first plane. In some embodiments the crossbar is split into two parts, the two parts each hingedly affixed to the handle such that the two parts hinge in the direction of gravity when not in use, and form a solid bar against which to press against when moving the bar in a direction opposite to gravity. The hinges may be oriented such that pivot axes of the hinges are oriented at least generally horizontally. The pivot axes may be parallel to one another. The pivot axes may extend transversely to the two parts of the crossbar. In some embodiments the pivot axes are oriented perpendicular to a front face of the carriage (i.e. in a front-rear direction).

Another aspect of the invention provides a method of resistance training, the method comprises: adjusting a position of a carriage along a linear guide to a desired starting position; with the carriage in the starting position anchoring a first fastener coupled to a first end of a flexible element to an anchor point fixed relative to the linear guide such that the flexible element extends from the first fastener at the anchor point, through a first coupling on the carriage, around a loop defined by a plurality of guiding elements and back to a second coupling on the carriage; and moving the carriage along the linear guide while the first fastener is coupled to the anchor point and thereby reducing a length of the loop such that the loop displaces a displaceable pulley against a force applied by a resistance element.

In some embodiments, the carriage can be detachably affixed to the post, for example with a pin. One or both ends of the flexible element may either connect to attachment points on the ends of the two sections of the crossbar or travel through a pulley on the ends of the cross bar and attaching at or near the carriage. When the user moves the crossbar in an arc the length of the flexible element is shortened, providing resistance for the user. The pins used to secure the crossbar may be inserted in holes on the top or bottom of the bar connecting the crossbar to the carriage to limit the travel of the crossbar to only above the starting position or only below the starting position.

It is emphasized that the invention relates to all combinations of the above features, with one another and/or with other features that are described elsewhere herein and/or depicted in the drawings even if these are recited in different claims, different paragraphs and/or different sentences.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
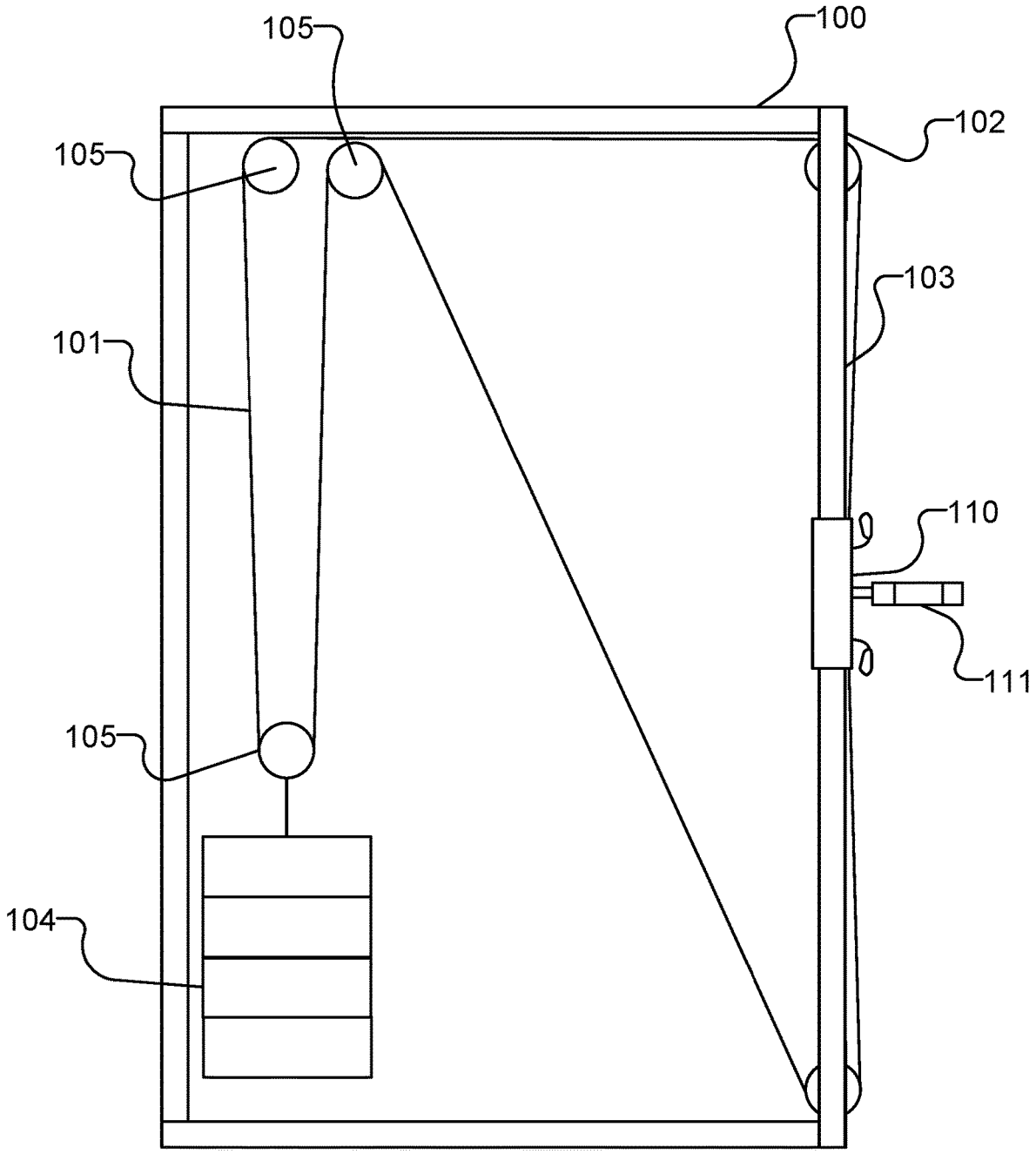
FIG. 1 is a side view of a weight lifting machine according to an example embodiment of this invention.

FIG. 1 shows a weight lifting machine 100 according to an example embodiment. Weight lifting machine 100 includes a carriage 110 slidably coupled to a post 102. Post 102 acts as a linear guide for carriage 110. A user of machine 100 may exercise by setting carriage 110 to a suitable starting point along post 102 and then moving carriage 110 away from the selected starting point against resistance provided by machine 100. The user may move carriage 110 by applying force to a handle 111 attached to carriage 110.

Figure 1A:
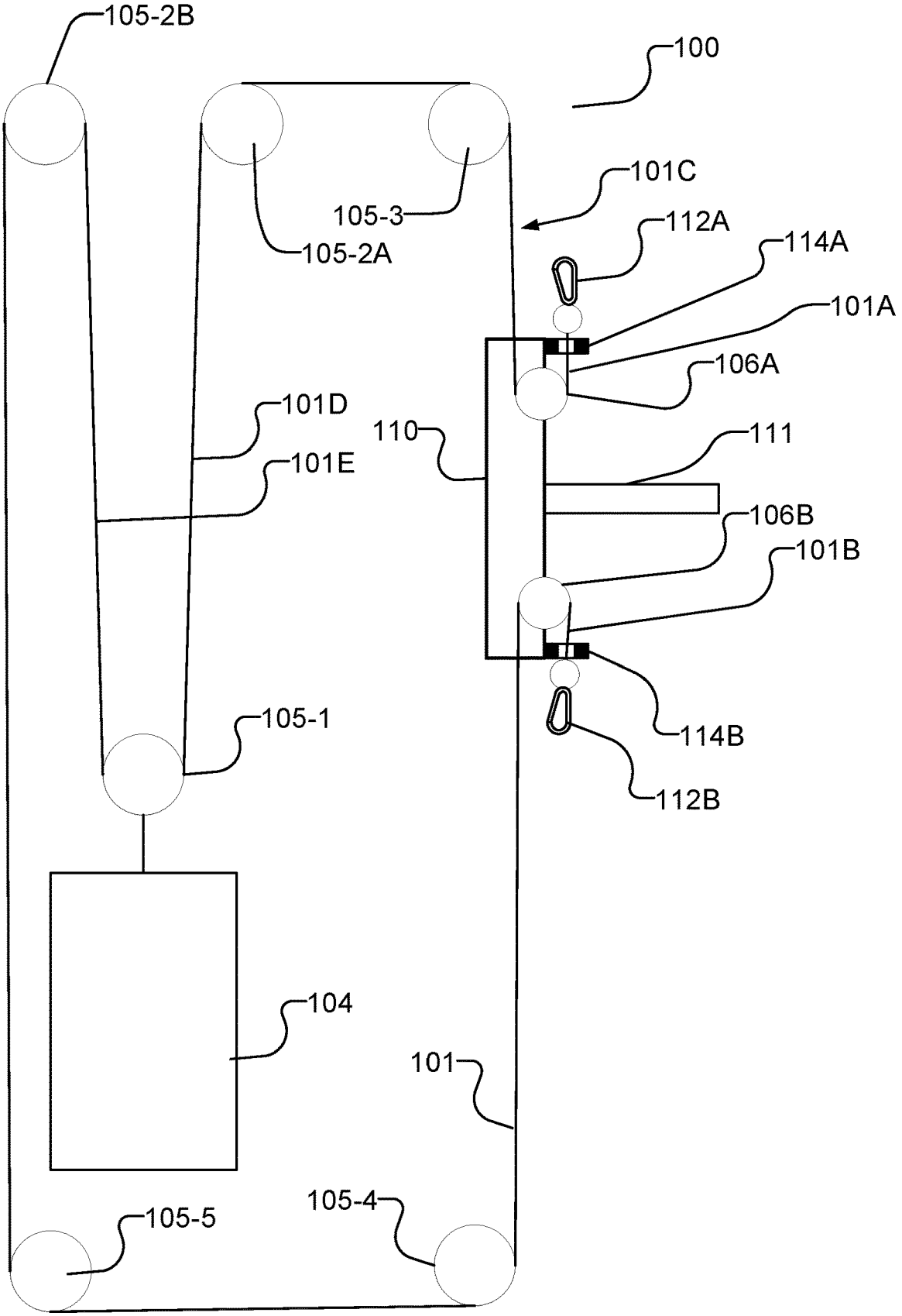
FIG. 1A is a schematic illustration of a weight lifting machine according to an example embodiment of this invention.

FIG. 1A is a schematic illustration that shows the operating mechanism of weight lifting machine 100. Weight lifting machine 100 includes a flexible element 101. First and second end portions 101A and 101B are coupled to carriage 110. The balance of flexible element 101 forms a loop 101C that extends from carriage 110 around a path defined by guiding elements and back to carriage 110. In the illustrated embodiments the guiding elements comprise pulleys 105. In some embodiments some or all of the guiding elements may be of other types such as grooved tracks or rails.

A resistance element 104 is coupled to pulley 105-1. Loop 101C passes through pulley 105-1. If the length of the portion of flexible element 101 that makes up loop 101C is reduced then pulley 105-1 is displaced against a force provided by resistance element 104. In FIG. 1A pulleys 105-2 to 105-5 are fixed and pulley 105-1 is movable.

FIG. 1A shows an example of the coupling of end portions 101A and 101B of flexible element 101 to carriage 110. Stops 114A and 114B respectively prevent end portions 101A and 101B from pulling out of carriage 110. In the example embodiment of FIG. 1A, end portions 101A and 101B respectively include fasteners 112A and 112B. Fasteners 112A and 112B include enlarged portions that act as stoppers which prevent fasteners 112A and 112B from pulling through stops 114A and 114B, thereby keeping end portions 101A and 101B coupled to carriage 110. It can be appreciated that carriage 110 can be moved to any point along post 102 without significant resistance. As carriage 110 is moved along post 102 in either direction loop 101C simply circulates around pulleys 105.

At carriage 110, end portions 101A and 101B may be doubled back around rollers 106A and 106B respectively. In other embodiments end portions 101A and 101B may extend straight along carriage 110 in opposing directions.

Machine 100 may be made to resist movement of carriage 110 along post 102 by connecting one of fasteners 112A and 112B to an anchor point. Anchor points may, for example, be provided on post 102 or on another structure close to post 102. Plural anchor points may be provided so that an anchor point is reasonably close to each of the fasteners 112A and 112B for any of a range of starting points for carriage 110 along post 102. In some embodiments an anchor point for receiving fastener 112A or 112B is provided on a movable member that may be placed (e.g. by clamping or other engagement) at a desired position proximate to a chosen starting point for carriage 110.

Figure 11A:
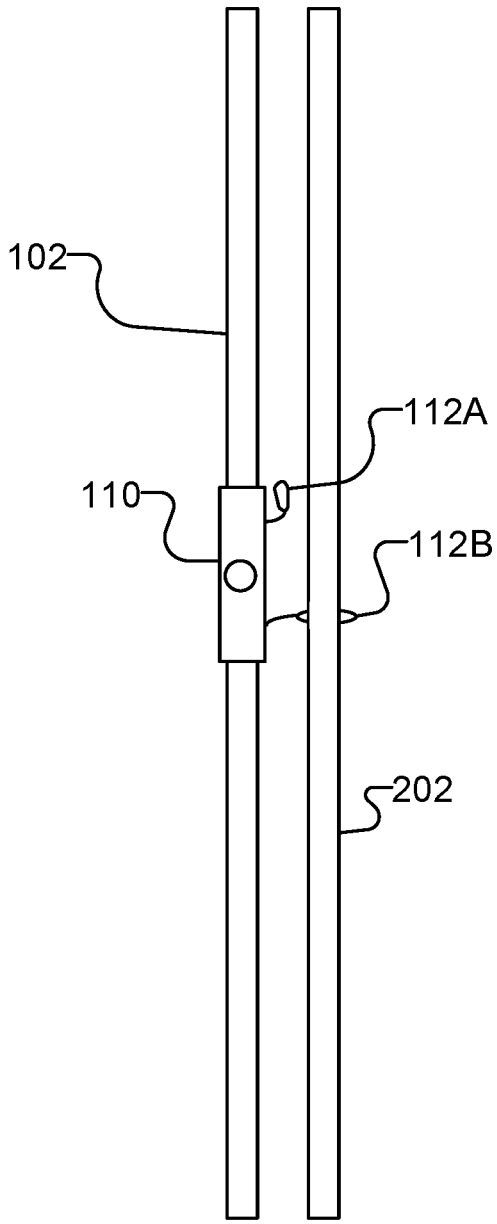
FIGS. 11A and 11B are partial front and partial cross-section views respectively of a weight lifting machine according to an example embodiment of this invention.
Figure 11B:
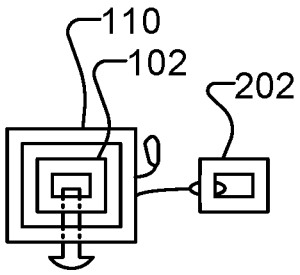

When one of fasteners 112A and 112B is connected to an anchor point, movement of carriage 110 away from the anchor point causes the length of the portion of flexible element 101 that forms loop 101C to be reduced. As noted above, the reduction in the length of loop 101C causes pulley 105-1 to be displaced against the force exerted by resistance element 104. At the same time, the tension in flexible element 101 causes a net force on carriage 110 that resists further movement of carriage 110 away from the anchor point. The anchor point may located on a further post 202, as shown in FIGS. 11A and 11B. One or both of fasteners 112A and 112B may attach to this further post 202. The anchor point on the further post 210 remains fixed relative to post 102.

In the embodiments illustrated in FIGS. 1 and 1A, resistance element 104 comprises a weight suspended from a bight of flexible element 101 that extends downwardly from pulleys 105-2A and 105-2B to pulley 105-1. In the illustrated embodiments pulleys 105-2A and 105-2B are shown as being separated by a distance that is larger than a diameter of pulley 105-1 such that in the bight, flexible element 101 forms a V-shape. This has been done for the sake of clarity in the drawings. In some embodiments pulleys 105-2A and 105-2B are separated by a distance that is substantially equal to a diameter of pulley 105-1 such that the portion 101D of flexible element 101 between pulley 105-2A and pulley 105-1 is parallel to the portion 101E of flexible element 101 between pulley 105-2B and pulley 105-1. This construction allows for a constant force to be applied against the user of weight machine 100 when in use (in cases where the force exerted by resistance element 104 does not vary with displacement of pulley 105-1). Pulleys 105 could also be arranged to define the path followed by flexible element 101 in the same manner as in U.S. Pat. No. 5,842,961, wherein the location of the pulleys are adjustable.

The construction described above enables a user of weight lifting machine 100 to move carriage 110 to their desired starting position for an exercise. Once carriage 110 is in the desired starting position, a selected one of fasteners 112A and 112B may be affixed to an anchor point. For an exercise involving moving carriage 110 downward along post 102 fastener 112A may be fixed to an anchor point above carriage 110. For an exercise involving moving carriage 110 upward along post 102 fastener 112B may be fixed to an anchor point below carriage 110.

Machine 100 may be varied from the embodiments illustrated in FIGS. 1 and 1A in many ways. These include, without limitation one or any combination of:

Post 102 is not necessarily oriented to be vertical. In some embodiments post 102 is inclined at an angle to vertical. In some embodiments post 102 is horizontal. In some embodiments an orientation of post 102 is adjustable.

Resistance element 104 may comprise any resistance element that exerts a force on flexible element 101 that resists reduction of the length of flexible element 101 that forms loop 101C.

The locations of pulleys 105 may be altered to cause flexible element 101 to follow different paths.

Some or all of pulleys 105 may be replaced by alternative guiding elements.

Handle 111 may have different forms that facilitate use for different exercises.

Post 102 may be replaced by other types of track or guide that constrain carriage 110 to move along a linear path.

Post 102 or other linear guide is not necessarily completely straight. For example, post 102 may be formed to curve slightly.

Fasteners 112A, 112B and the anchor points that the fasteners 112A, 112B can be attached to may take any of a wide range of forms.

Flexible element 101 may take any of a wide range of forms.

Machine 100 may be a stand-alone machine or may form a part of a larger piece of exercise equipment (such as, but not limited to, a Smith machine, a multi-gym, or a part of a weight lifting machine that also provides other functions).

Flexible element 101 may comprise any elongated flexible member flexible capable of resisting tensional forces. For example, flexible element 101 may comprise a wire, a band, a cable, a chain, a strap, a cord, a belt, etc. In some embodiments flexible element 101 comprises a plastic coated wire cable.

In the example embodiment of FIG. 1, resistance element 104 comprises a stack of weights. A user may vary the number of weights that are coupled to move with pulley 105A to change the amount of resistance applied by resistance element 104. Other embodiments may use different types of resistance elements such as, for example: other types of weight such as a basket, tray or carriage adapted to support: round weight plates, dumbbells, kettlebells, medicine balls, or rocks; a spring or other elastically extensible element; a hydraulic or pneumatic damper; resistance bands or tubes; (an) electric motor(s).

Handle 111 may take any of a wide variety of forms. By way of non-limiting example, handle 111 may comprise any of: a cannonball grip, a nunchuck grip, a stirrup handle, a dog bone grip, a seated row handle, a tricep handle, a straight bar, a curl bar, a V-bar, a triceps rope, and an ankle strap. In some embodiments a grippable part of handle 111 is mounted to rotate relative to carriage 110 (e.g. handle 111 may comprise a rotatable straight bar or curl bar). In some embodiments, handle 111 is detachable and a machine 100 may comprise a set of different handles that may be attached to carriage 110 for use in performing different exercises.

Figure 2:
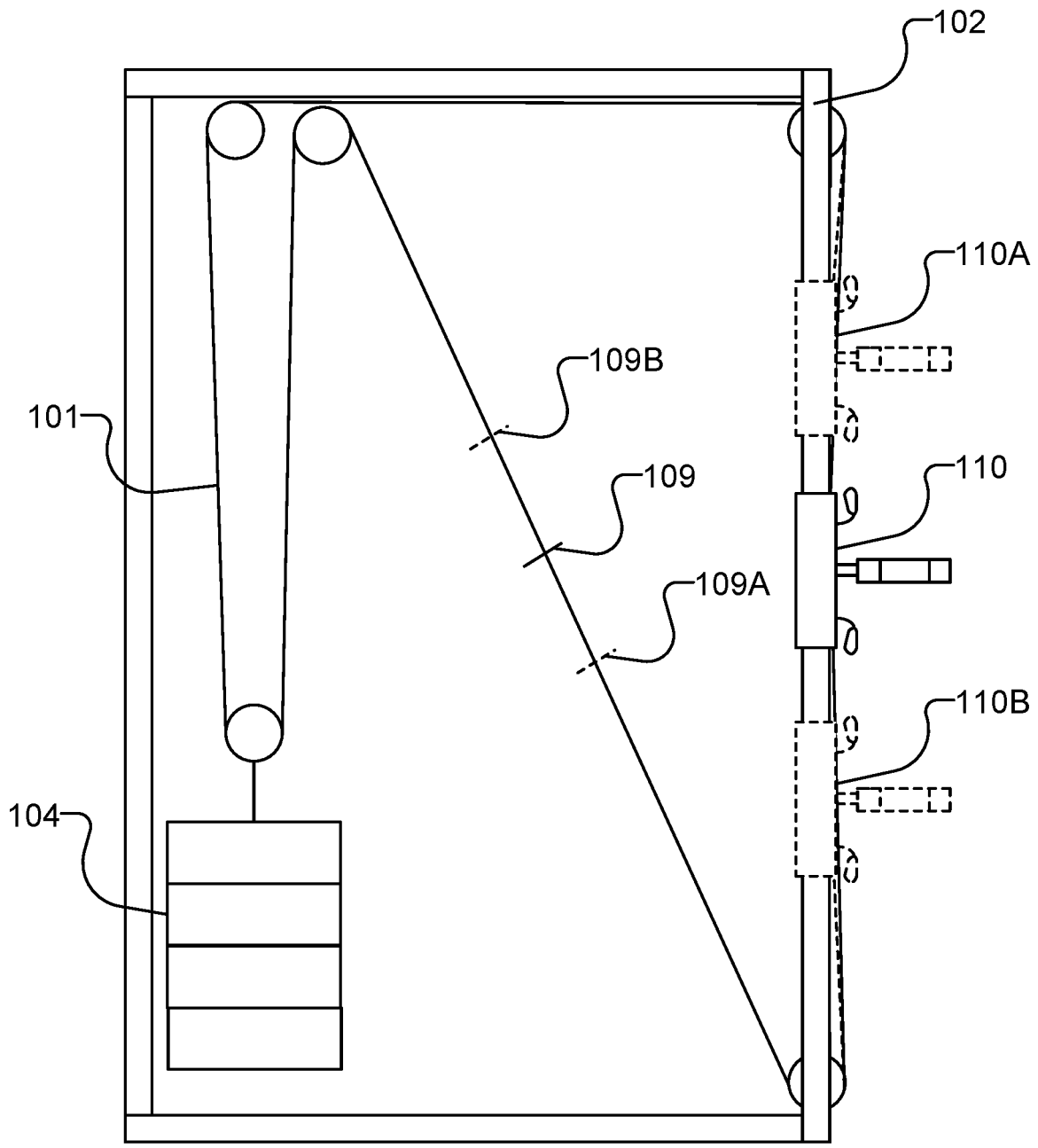
FIG. 2 is a side view of a weight lifting machine with the carriage's height being adjusted according to an example embodiment of this invention.

FIG. 2 shows a weight lifting machine 100 being adjusted according to an example embodiment. Neither one of fasteners 112A, 1128 is affixed to an anchor point. A user might wish to adjust the height of carriage 110 for ergonomic reasons, or to perform different exercises. Due to the arrangement of flexible element 101 whose ends terminate at carriage 110 when not being used for resistance training, carriage 110 can be moved along post 102 with substantially no resistance from resistance element 104. This enables a user to easily move carriage 110 along post 102 to a desired starting position. Movement of carriage 110 merely causes the portion of flexible element 101 that forms loop 101C to circulate. In FIG. 2, point 109 is a reference point corresponding to an arbitrary location on flexible element 101. When carriage 110 is moved upward along post 102 to point 110A, point 109 moves to point 109A. When carriage 110 is moved downward along post 102 to point 1108, point 109 moves to point 109B.

Figure 3:
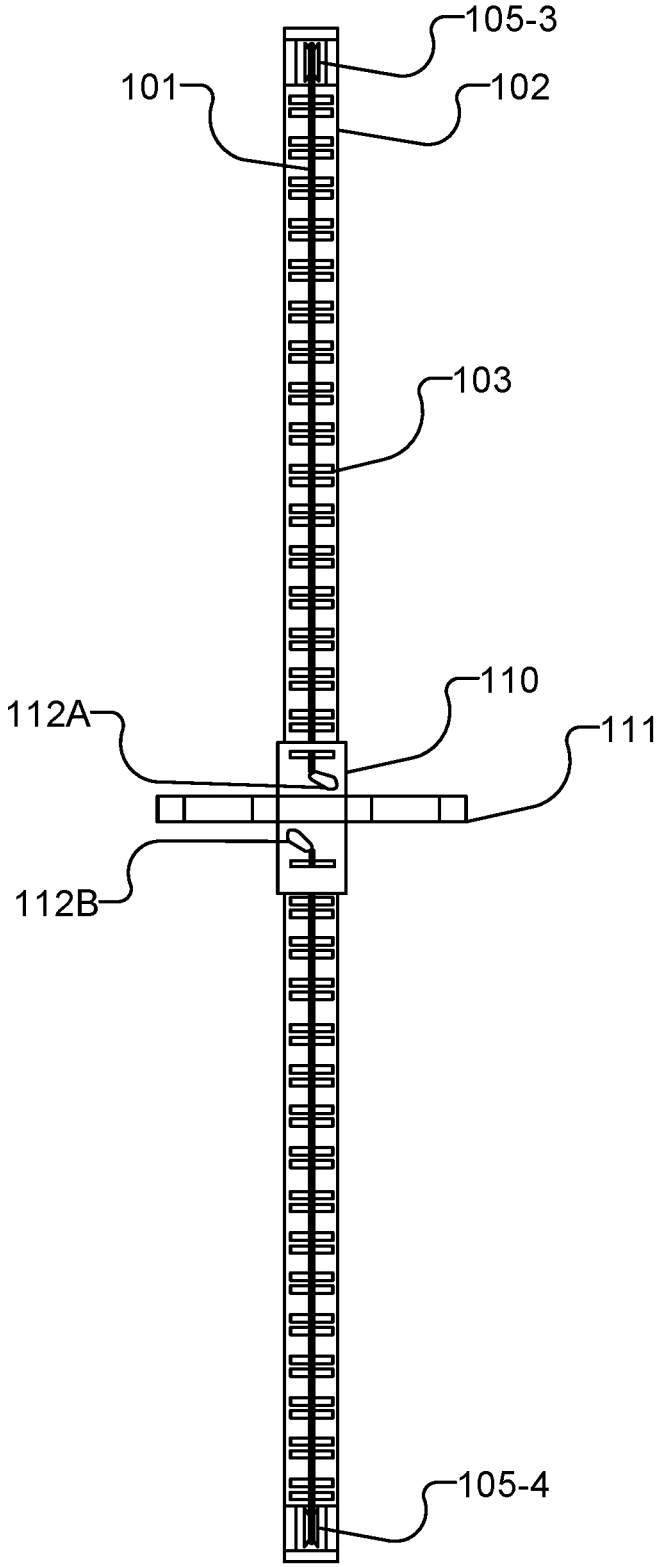
FIG. 3 is a front view of a post for a weight lifting machine according to an example embodiment of this invention.

FIG. 3 is a front view of post 102 and carriage 110. To use the weight lifting machine 100 for resistance training one of fasteners 112A, 1128 is fastened to an anchor point. The anchor point may be on post 102 or on an adjacent structure. FIG. 3 shows receivers 103, which are designed to accept fasteners 112A and 1128. Receivers 103 form an integral part of post 102 in the example embodiment of FIG. 3. In some embodiments, receivers 103 are spaced along another post or wire located near post 102. At both ends of post 102 are pulleys 105-3 and 105-4. Pulleys 105-3 and 105-4 keep flexible element 101 parallel to post 102.

It is not mandatory that anchor points for fasteners 112A, 1128 are in predefined positions. In some embodiments anchor points are provided by clamping elements that can be temporarily clamped to post 102 or an adjacent structure at any desired position along post 102.

In embodiments like that illustrated by FIG. 3, fasteners 112A and 112B can be affixed to one of receivers 103 to fix an end of flexible element 101 relative to post 102 to configure weight lifting machine 100 for use for resistance training.

In FIG. 3, fasteners 112A and 112B are shown as being clips or carabiners. In FIG. 3, receivers 103 are of a 'ladder' type formed by apertures in post 102. A user can affix one of fasteners 112A and 112B to one of the receivers 103 by hooking the carabiner-type fastener 112A or 112B to the one of receivers 103. Other embodiments may use different fasteners and receivers, for example: a fastener may comprise a pin or hook that can be received in a hole; a fastener may comprise a threaded bolt that can be received in a threaded receiver, and/or a fastener may comprise a hook that can engage an eye or a loop or eye that can engage a hook.

Figure 4A:
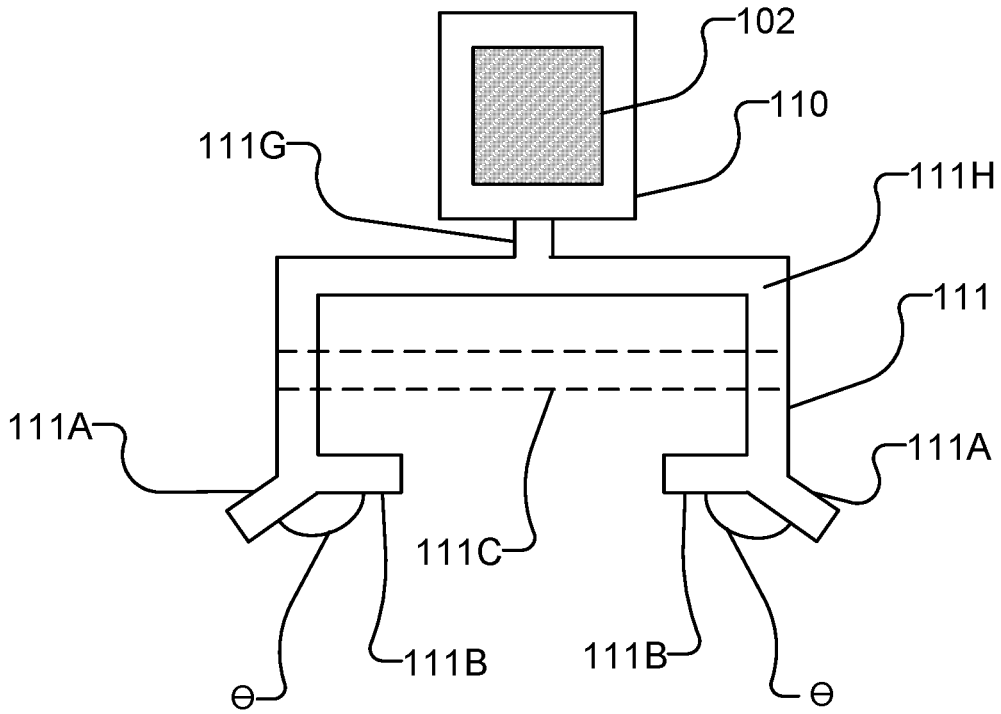
FIG. 4A is a sectional view of a handle for a weight lifting machine according to an example embodiment of this invention.

FIG. 4A is a sectional view of post 102, carriage 110, and handle 111. In this example embodiment, carriage 110 wraps around post 102. Handle 111 is attached to carriage 110. In the example embodiment shown in FIG. 4A, post 102 and carriage 110 have a square cross section, but post 102 and carriage 110 may have any cross sectional shape and they need not have the same cross sectional shape.

Figure 4B:
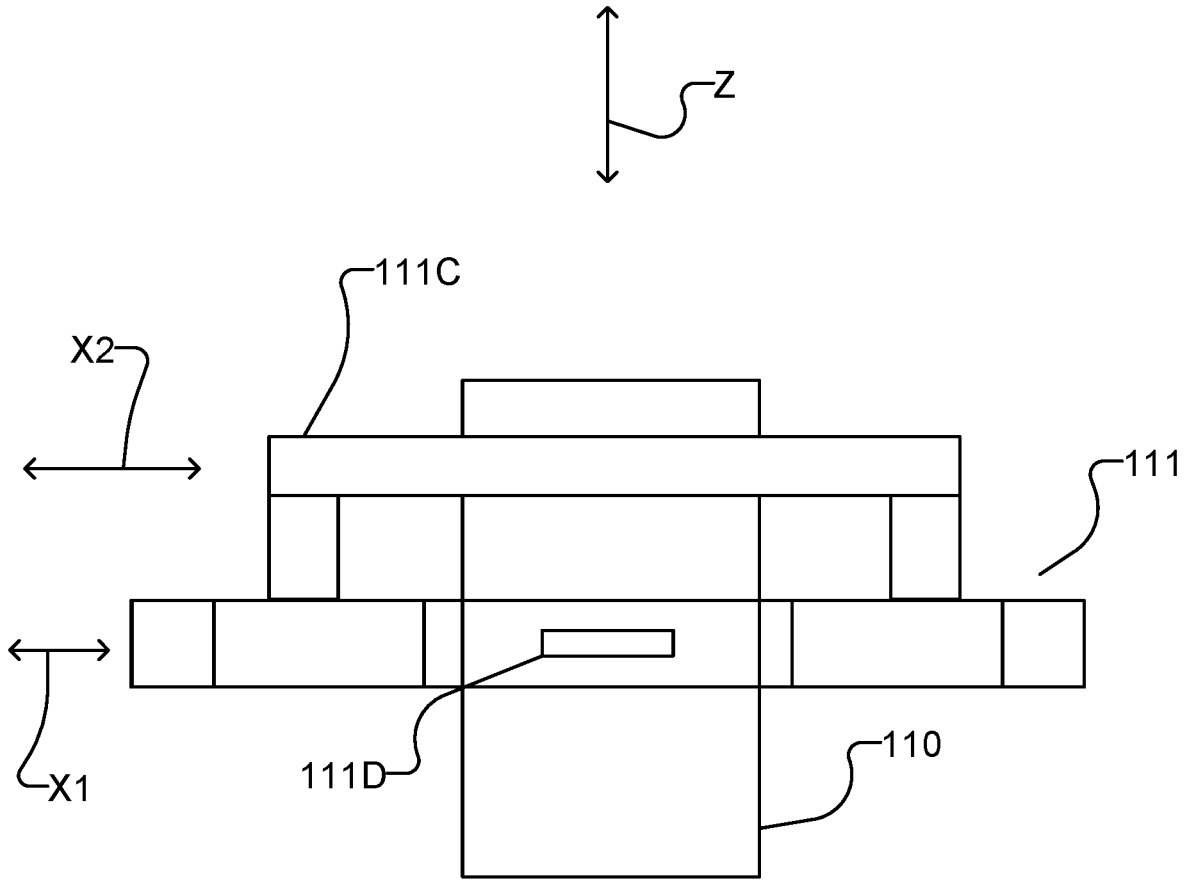
FIG. 4B is an elevation view of a handle for a weight lifting machine according to an example embodiment of this invention.

FIG. 4B is an elevation view of carriage 110 and handle 111. In this example, handle 111 is detachable from carriage 110 at detachment point 111D. This enables a user to select different handles depending on the desired exercise.

The particular handle 111 illustrated in FIGS. 4A and 4B is intended for exercising the latissimus dorsi muscles (by holding onto grip 111A shown in FIG. 4A), the biceps brachii muscle (by holding onto grip 111B shown in FIG. 4A), or the quadriceps femoris (by resting one's shoulders on bar 111C and pushing upwards). Grip 111A and grip 111B form an angle $\Theta$, where $\Theta$ is greater than 90 degrees but less than 180 degrees (and therefore forms an obtuse angle), where angle $\Theta$ faces away from post 102. Post 102 and carriage 110 lie in a plane represented by arrow Z. Bar 111C lies in a plane represented by arrow X2. Grip 111A and 111B, and base 111G lie in a plane represented by arrow X1. Arrow X1 and X2 are parallel to each other. Arrow Z is orthogonal to arrow X1 and X2. Handle 111 includes an arc shaped segment 111-H to which grip 111A, grip 111B and bar 111C are attached. A convex side of the arc-shaped segment 111-H faces carriage 110. Grips 111A and 111B are placed at the two opposing ends of the arc shaped segment 111-H. Bar 111C is attached to the opposing ends of the arc shaped segment 111-H. In some embodiments bar 111C is fixed to handle 111. In other embodiments bar 111C may be detachable.

Figure 4C:
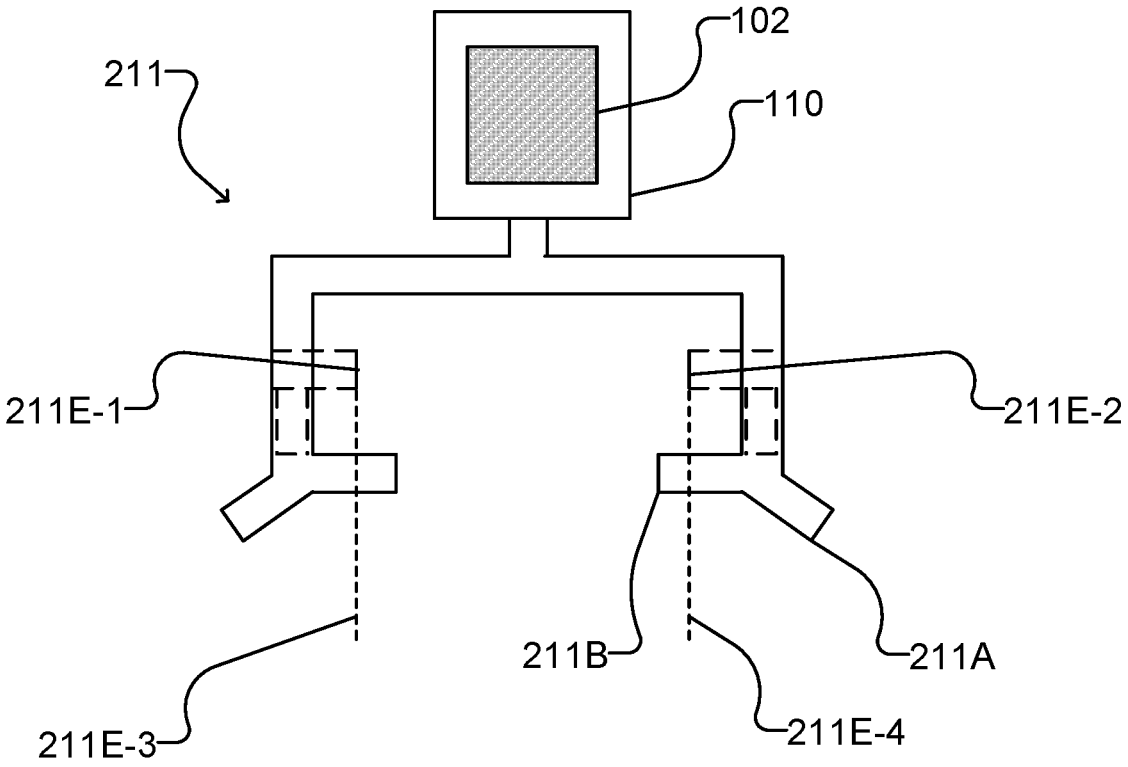
FIG. 4C is a sectional view of a hinged handle for a weight lifting machine according to an example embodiment of this invention.
Figure 4D:
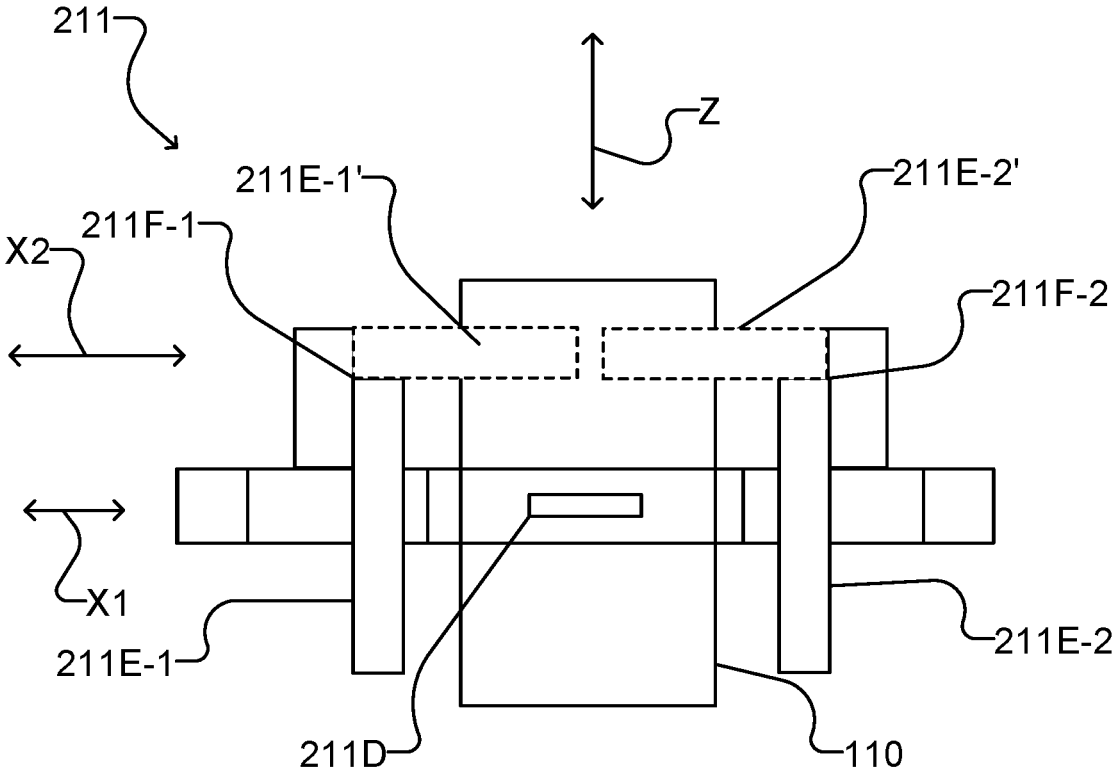
FIG. 4D is an elevation view of a hinged handle for a weight lifting machine according to an example embodiment of this invention.

FIGS. 4C and 4D show a handle 211 according to another example embodiment. Handle 211 is detachable from post 102 at detachment point 211D. Squat half bars 211E-1 and 211E-2 are hingedly connected to handle 211 at hinge points 211F-1 and 211F-2 respectively. Squat half bars 211E-1 and 211E-2 hinge about hinge axes 211E-3 and 211E-4 respectively. Squat half bars 211E-1 and 211E-2 hinge downward under the influence of gravity in a stowed position when not in use. When a user pushes upward on squat half bars 211E-1 and 211E-2, they will lock into place and form a solid bar against which to press as shown by squat half bars 211E-1' and 211E-2' in their deployed position.

FIGS. 4E to 4K show handle 311 and handle 411 according to other example embodiments. Handle 311 shares some features of handles 111 and 211 such as grip 311A, grip 311B, and squat half bars 311E. Other features of handle 311 will now be described. Handle 311 includes a first segment 312, a second segment 314 and a pair of arms 316, 316'. Handle 411 shares many of the features of handle 311 and is discussed in detail below.

First segment 312 may be fixed to carriage 110, or detachably connected to carriage 110 for example by a pair of pin plates 318 with pin 318A. When first segment 312 is fixed to carriage 110 it may be fixed allowing rotation between carriage 110 and first segment 312 at pivot points 325, 325' as in FIG. 4E, or may be fixed not allowing rotation. As best shown in FIGS. 4K and 4L, pin plates 318 may include multiple holes 320A, 320B, 320C for connecting handle 311 at different angles to carriage 110 and therefore post 102. FIG. 4K shows an embodiment where first segment 312 pivots at pin plate 318. FIG. 4L shows an embodiment where first segment 312 pivots at pivot point 325, but may be locked at pin plate 318. For example, pin 318A may be used to secure first segment 312 at hole 320A to angle handle 311 upward, at hole 320B to handle 311 at the horizontal, and at hole 320C to angle handle 311 downward. While pin plate 318 is shown having 3 holes, this is only an example embodiment. Other embodiments may have more or less holes in pivot plate 318. In some embodiments, as shown in FIG. 4E, both pin plates 318 and pivot points 325, 325' may be used to both fix first segment 312 to carriage 110 and allow connection of handle 311 at different angles to carriage 110 and therefore post 102.

Figure 12:
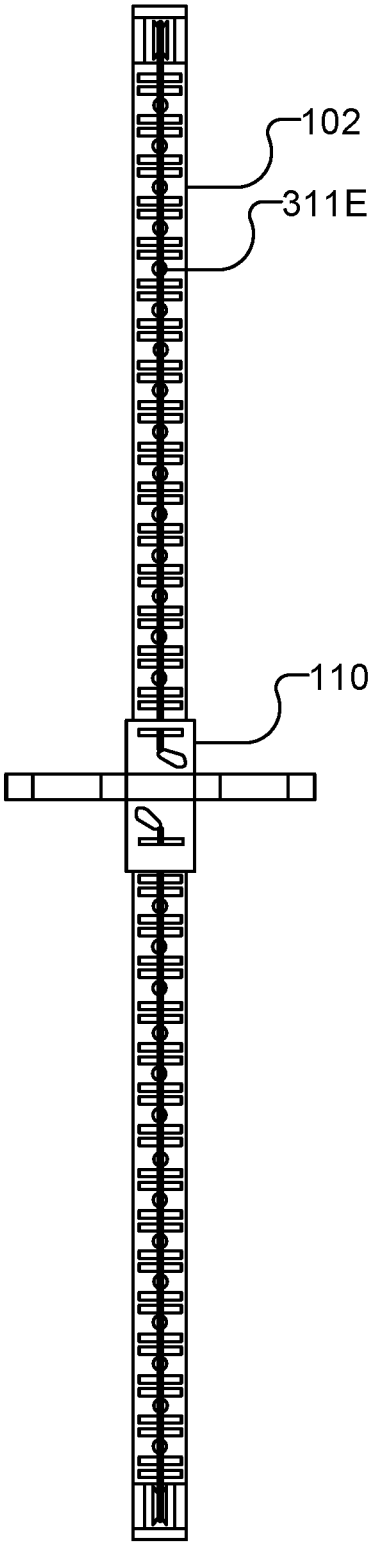
FIG. 12 is a front view of a post for a weight lifting machine according to an example embodiment of this invention.

As best shown in FIGS. 4K and 12, carriage 110 is detachably pinned with pin 311D in a hole 311E on post 102. Carriage 110 may include one or both of isometric stoppers 313, 313'. Isometric stoppers 313, 313' are pivotally attached to carriage 110 at pivot point 315 and have a hook portion 317 or other suitable means engageable with receivers 103 of post 102. The hook portion may be configured like a detent mechanism. Isometric stoppers 313, 313' may be actuated by a user by suitable means, for example by pressing a button 319 located on one or both of grips 311A, 311B, 311C, or any other convenient location on handle 311 (in the illustrated embodiment button 319 is located on grip 311B). In some embodiments isometric stoppers 313,313' may remain actuated for as long as button 319 is pressed. In other embodiments isometric stoppers 313, 313' may actuate upon one press of button 319, and release upon a second press of button 319. In some embodiments, pin 311D may be detached when isometric stoppers 313,313' are intended to be used. In some embodiments isometric stoppers 313, 313' may incorporate load cells or scales (not shown) for detecting, measuring and/or recording the load put on the isometric stopper. A display (not shown) showing the read-out of the measurement(s) recorded by the load cells or scales may be provided in a location for convenient viewing by the user. Additionally or alternatively, the measurement(s) may be announced a digital voice device. In use, actuation of isometric stopper 313 will stop upward movement of carriage 110, facilitating isometric exercises where handle 311 is pushed or pulled upward; and actuation of isometric stopper 313' will stop downward movement of carriage 110, facilitating isometric exercises where handle 311 is pushed or pulled downward.

Figure 4E:
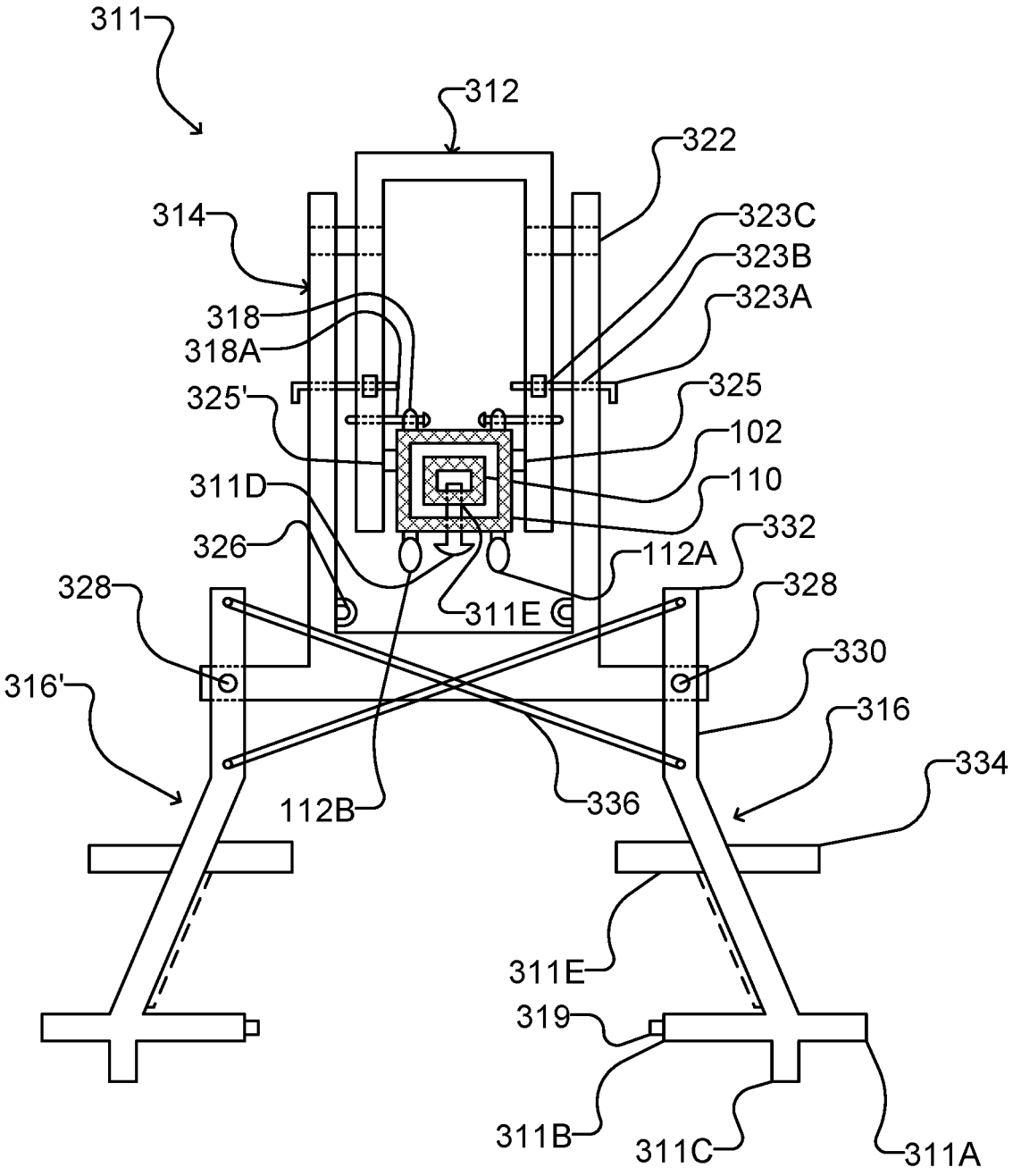
FIG. 4E is a sectional view of a handle for a weight lifting machine according to an example embodiment of this invention.
Figure 4F:
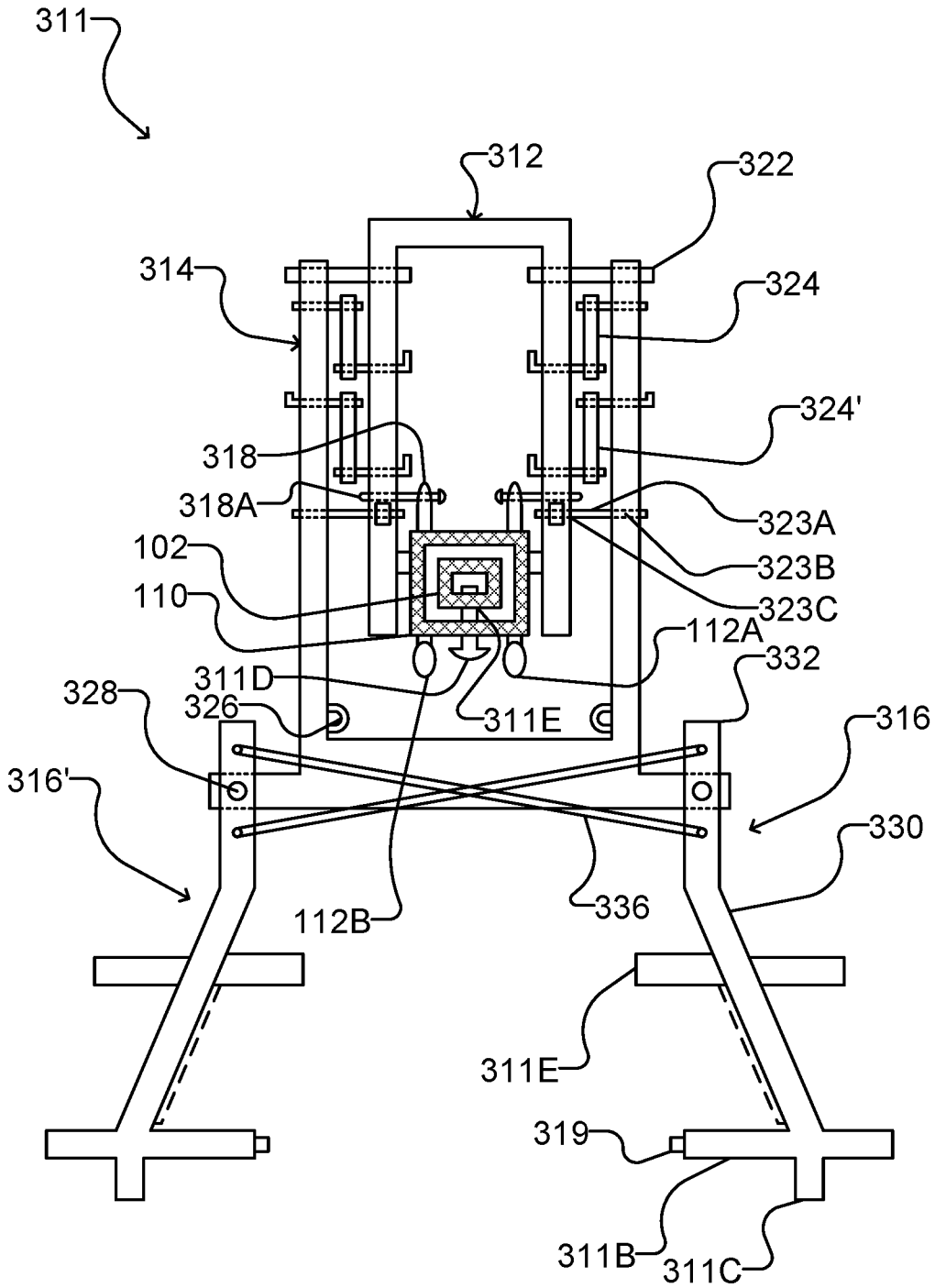
FIG. 4F is a sectional view of a handle for a weight lifting machine according to an example embodiment of this invention.
Figure 4G:
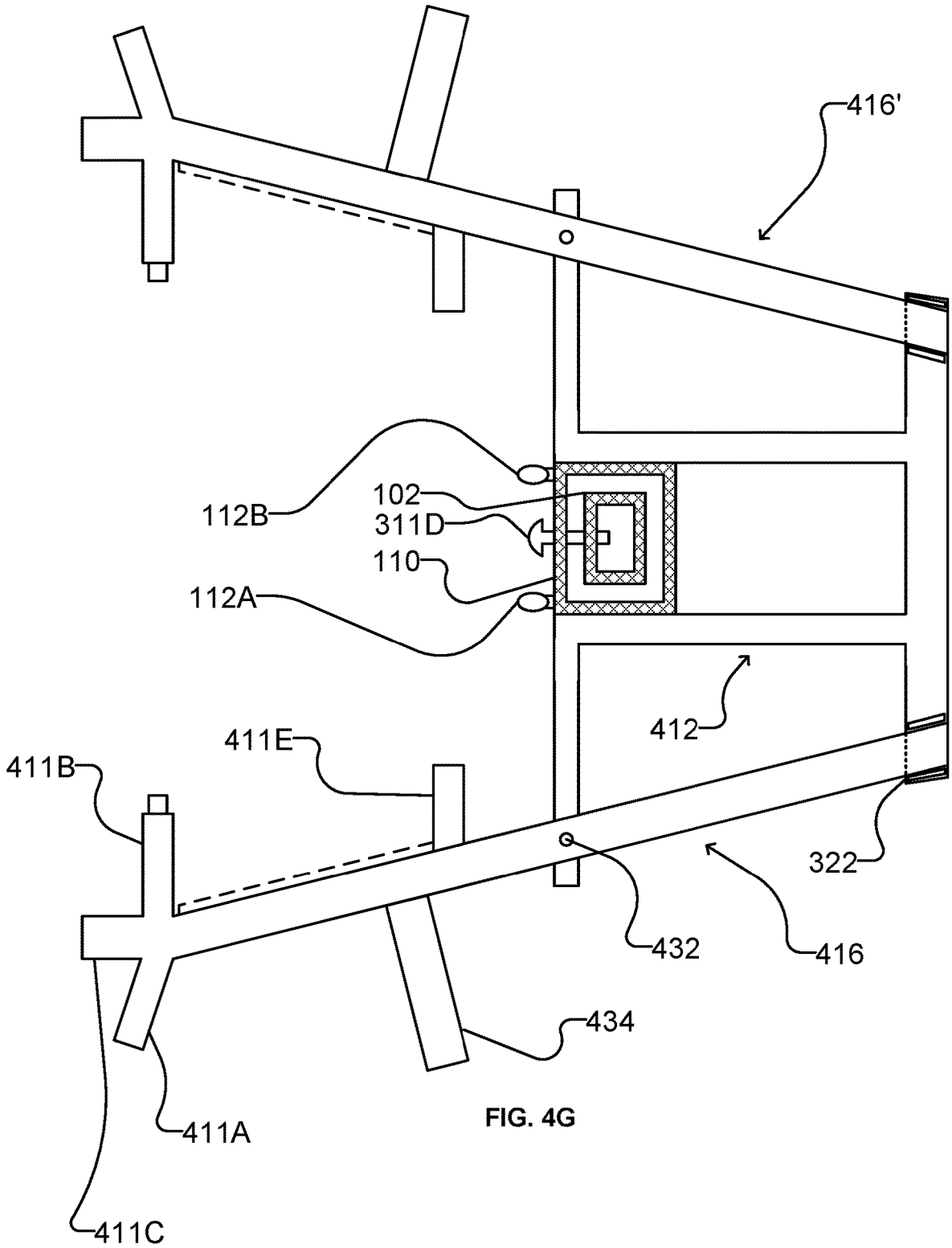
FIG. 4G is a sectional view of a handle for a weight lifting machine according to an example embodiment of this invention.
Figure 4H:
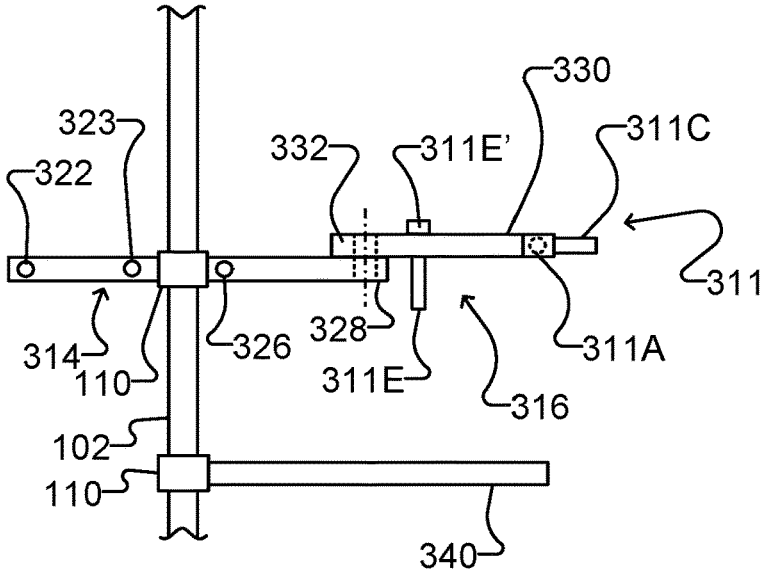
FIG. 4H is a side elevation view of a handle for a weight lifting machine according to an example embodiment of this invention.
Figure 4I:
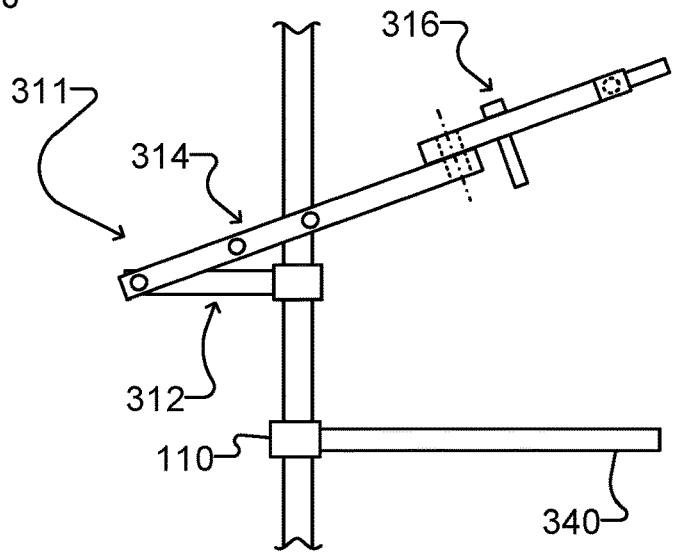
FIG. 4I is a side elevation view of a handle for a weight lifting machine according to an example embodiment of this invention.

In the embodiment shown in FIGS. 4E and 4I, first segment 312 and second segment 314 are pivotally connected at pivot point 322. In a locked configuration, first segment 312 and second segment 314 are also connected at point 323 for example by pin holes 323B,323C and a locking pin 323A. When a user desires to angle handle 311 upwardly or downwardly, second segment 314 may be pivoted accordingly, such as shown in FIG. 4I, and second segment 314 may be secured in position for example by using suitable means to pin second segment 314 to post 102. The attachment of second segment 314 to post 102 may allow one or more of: rotation between second segment 314 and pole 102, motion along the axis of second segment 314, and motion along the axis of pole 102. Locking pin 323A may be used to limit the range of motion of second segment 314 relative to first segment 312. If only motion of second segment 314 above first segment 312 is desired locking pin 323A may be inserted in only pin hole 323B when second segment 314 is above first segment 312 to prevent second segment 314 moving below first segment 312. If only motion of second segment 314 below first segment 312 is desired locking pin 323A may be inserted in only pin hole 323B when second segment 314 is below first segment 312 to prevent second segment 314 moving above first segment 312. If the full range of motion of second segment 314 above and below first segment 312 is desired locking pin 323A may be removed completely without securing second segment 314 to post 102, allowing second segment 314 to move in a full arc across first segment 312.

Figure 4J:
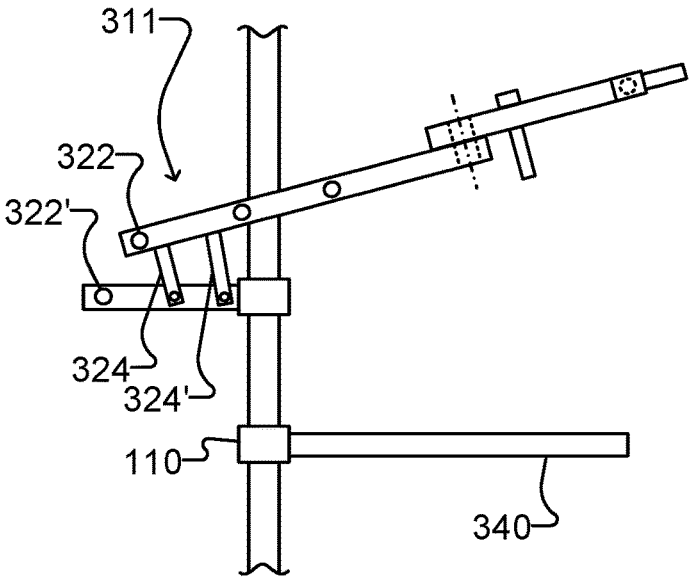
FIG. 4J is a side elevation view of a handle for a weight lifting machine according to an example embodiment of this invention.
Figure 4K:
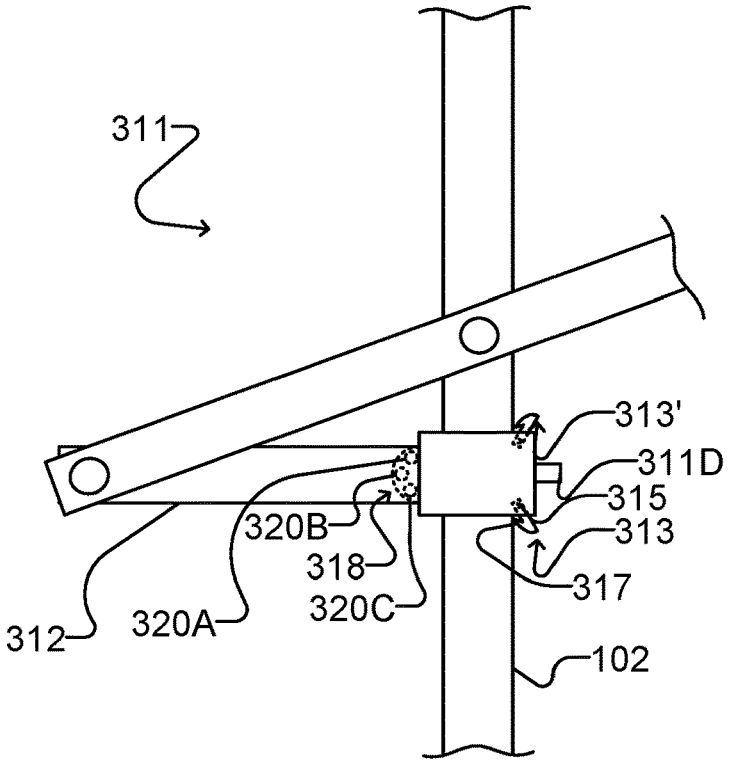
FIG. 4K is a close up partial side elevation view of a handle for a weight lifting machine according to an example embodiment of this invention.
Figure 4L:
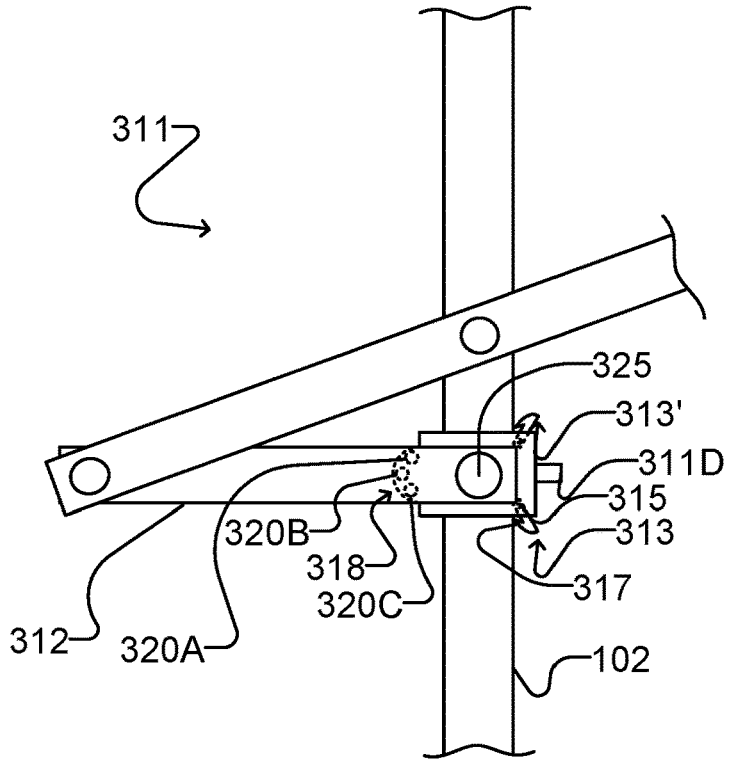
FIG. 4L is a close up partial side elevation view of a handle for a weight lifting machine according to an example embodiment of this invention.

In the embodiment shown in FIGS. 4F and 4J, handle 311 may be angled upwardly or downwardly and also toward the user. First segment 312 detaches from second segment 314 via hinges 324, 324' deployed to facilitate this movement, as best shown in FIG. 4J. Hinge 324 and hinge 324' may be of the same or of different lengths. Hinges 324, 324' may be of variable length, for example the may change lengths through a mechanism to collapse and expand the lengths of hinges 324, 324' and lock them at a desired length, through having multiple pinholes so pins may be inserted at different lengths along hinges 324, 324', by allowing a user to change a hinges 324, 324; for alternative hinges 324, 324' of other lengths, or through any other mechanism.

Point 326 on second segment 314 may be used to shorten the length of flexible element 101 otherwise available. For example point 326 may serve as an anchor point, such as a hook or other suitable element for fixedly engaging an end of flexible element 101 after that end is pulled through stop 114A or 114B. Alternatively, point 326 may be a pulley, for the end of flexible element 101 to be looped around and then returned to carriage 110 for fastening as described herein.

In the embodiments shown in FIGS. 4E, 4F, and 4H to 4J, second segment 314 is connected to each of arms 316,316' at hinge points 328. Arms 316,316' are generally Z shaped when viewed from above and below and linear when viewed from the side. Arms 316, 316' are generally in a horizontal plane above second segment 314. Arms 316,316' have a distal portion 330 and a proximal portion 332. Distal portion 330 may include grips 311A, 311B, 311C and squat half bars 311E. Distal portion 330 may also include plate horns 334 and squat half bars 311E. Cross-cables 336 may be provided to provide tension between arms 316,316' for relevant exercises involving pulling in or pushing out arms 316,316'. One end of each of cables 336 is attached to proximal portion 332 and the other end of each of cables 336 is attached to distal portions 330.

FIG. 4G shows handle 411 according to another example embodiment. Handle 411 shares some features of handles 111, 211, and 311, such as the connection between the first segment and the carriage as described herein (details not shown). Handle 411 includes a generally H-shaped first segment 412 and a pair of arms 416, 416'. Unlike handle 311, handle 411 combines the second segments and the arms into single elements, namely arms 416, 416' First segment 412 is attached to arms 416, 416' at knuckle joints 422. First segment 412 may have any of the features described herein for first segment 312. Arms 416, 416' may be locked to first segment 412 at point 432, for example by a hole and pin. Arms 416, 416' may have features similar to arms 316, 316', such as grips 411A, 411B, 411C, squat half bars 411E, and plate horns 434.

Handles 111, 211, 311 and 411 are not limited to use in exercise machines of the type described herein but has independent application in exercise machines of other types as well.

In some embodiments, two carriages 110 each with a handle as described herein may be provided on a post 102, wherein the user uses the higher handle/carriage combination for exercises where it is convenient for the handle to be higher, and the user uses the lower handle/carriage combination for exercises where it is convenient for the handle to be lower. In some embodiments a top carriage 110 with a handle as described herein, and a bottom carriage 110 supporting a platform 340, may be provided on a post 102, wherein the user may use the platform to support one foot or both feet depending on the exercise. In some embodiments fastener 112B may attach to bottom carriage 110 to provide assistance when the user is standing on platform 340 performing exercises such as hangs from handles 111, 211, 311, 411. Platform 340 may be detachable from the carriage 110.

Figure 5:
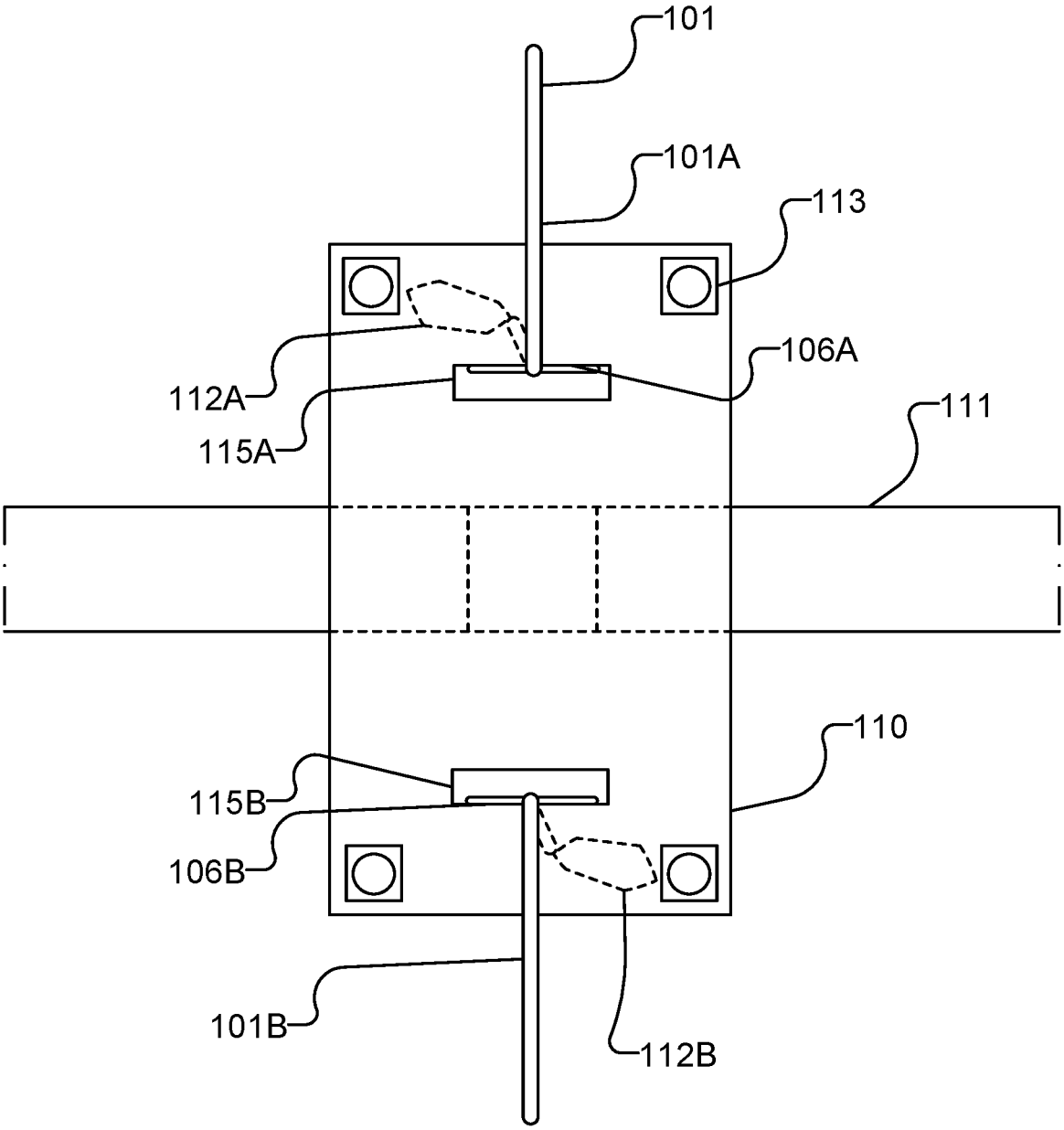
FIG. 5 is a cross sectional view of a carriage according to an example embodiment of this invention.

FIG. 5 shows an internal view of and example carriage 110. The view depicted in FIG. 5 is the side of carriage 110 that faces receivers 103 on post 102. Between post 102 and carriage 110 is a friction reducing element. For example, in FIG. 5 the friction reducing element is a series of ball bearings 113. FIG. 5 shows four ball bearings at each corner of the carriage, but there could be any number of ball bearings on the carriage. Furthermore, though ball bearings are depicted in FIG. 5 as reducing the friction between carriage 110 and post 102, multiple other forms of friction reducing elements may be provided in place of or in combination with ball bearings 113. Friction reducing elements may, for example comprise a lubricant (e.g. grease, oil, a synthetic lubricant), plastic pads, wheels, a linear bearing, a magnetic bearing, an air bearing or any combination thereof.

In the particular arrangement shown in FIG. 5, end portions 101A and 101B of flexible element 101 each pass between post 102 (not shown in FIG. 5) and carriage 110, and loop back through openings 115A and 115B. Rollers 106A and 106B are provided respectively at the top edge of opening 115A and the bottom edge of opening 115B. Rollers 106A and 106B reduce the friction between flexible element 101 and carriage 110, and allow flexible element 101 to loop back over itself with little resistance. At the ends of flexible element 101 are fasteners 112A and 112B. Fasteners 112A and 112B serve at least two purposes, which are (1) fastening an end of flexible element 101 to one of the receivers 103 on post 102, and (2) keeping the ends of flexible element 101 coupled to carriage 110 by acting as stoppers. In the illustrated embodiment, openings 115A and 115B serve as stops.

The way in which end portions 101A, 101B of flexible element 101 are coupled to carriage 110 may be varied. For example, in other example embodiments end portions 101A, 101B may pass around corresponding pulleys mounted on the exterior of carriage 110. In other example embodiments end portions 101A and 101B may be threaded through openings 115A and 115B from the outside to the inside (i.e. passed through opening 115A/B from the side of the carriage with the handle to the side of the carriage facing the post), rather than inside to outside as depicted in FIG. 5.

Figure 6A:
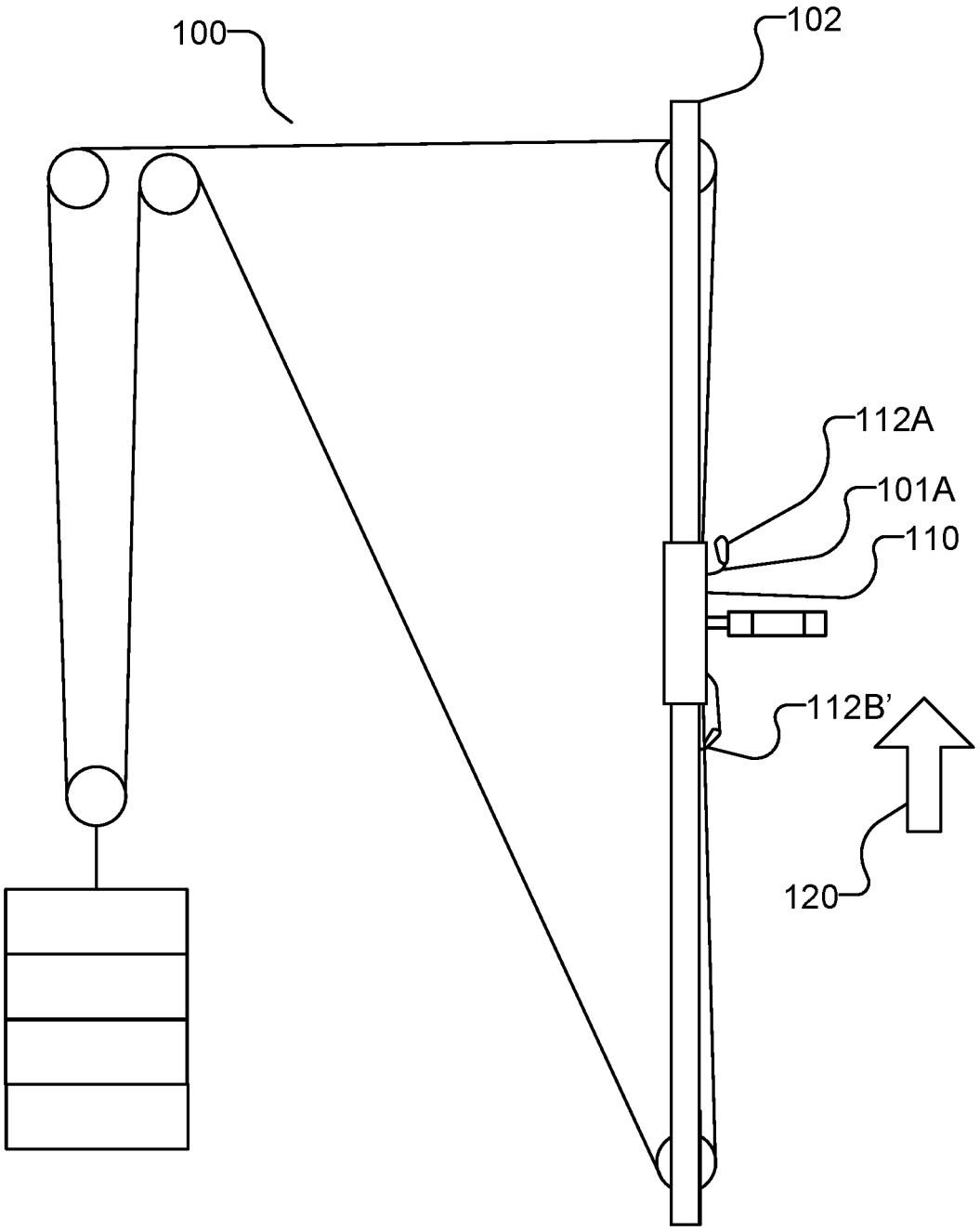
FIG. 6A is a weight lifting machine whose lowermost fastener is latched onto the post of the weight lifting machine according to an example embodiment of this invention.

FIG. 6A shows a weight lifting machine 100 being used for resistance training. The user of the weight lifting machine in FIG. 6A has adjusted carriage 110 to their desired height. Fastener 112B' has been affixed to one of the receivers 103 (not shown in FIG. 6A) on post 102. Fastener 112A has not been affixed to one of the receivers 103 on post 102, and keeps end portion 101A of flexible element 101 coupled to carriage 110, acting as a stopper. In the example embodiment of FIG. 6A, the user of the weight lifting machine is preparing to move carriage 110 in the direction represented by arrow 120.

Figure 6B:
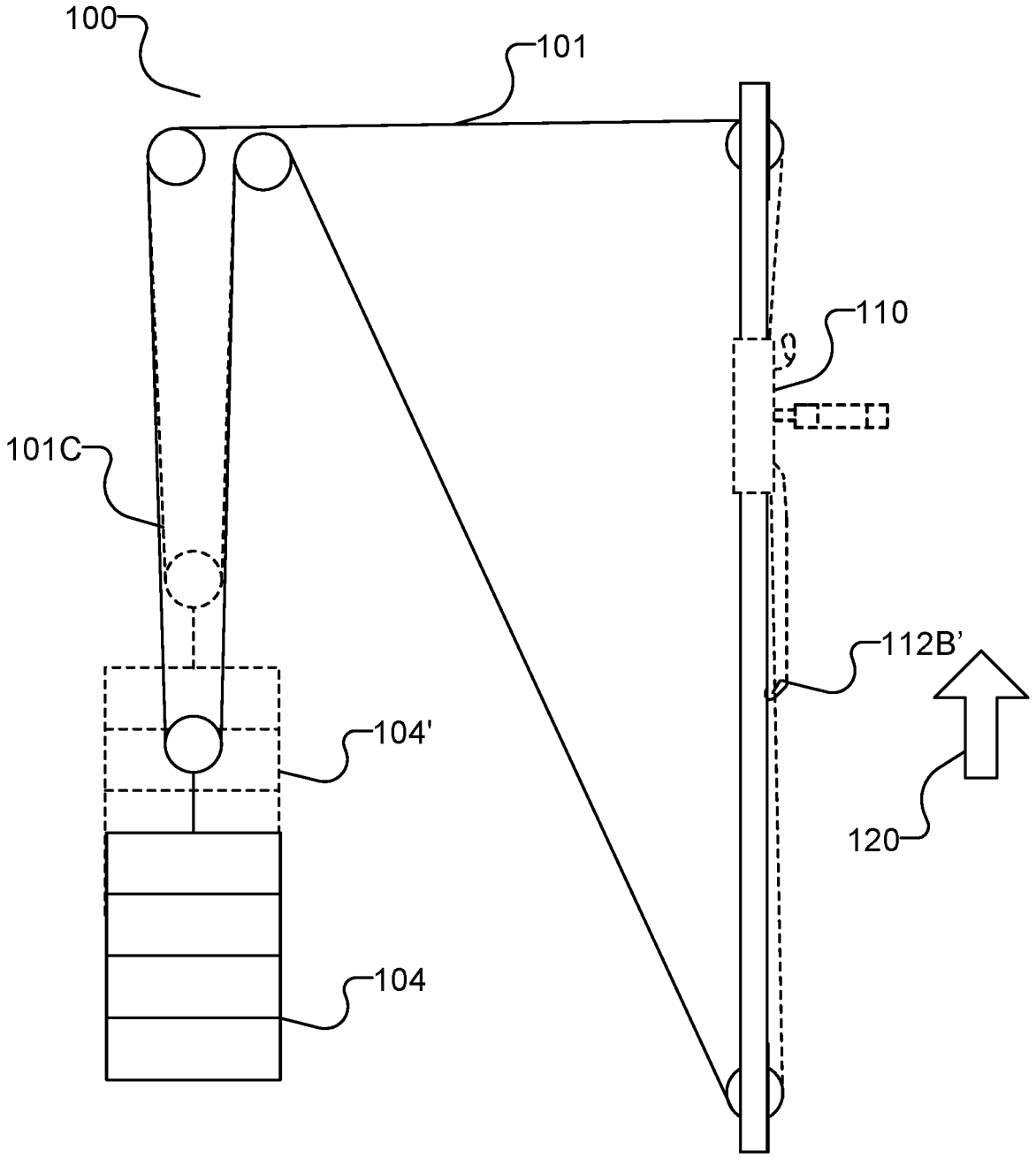
FIG. 6B is a weight lifting machine whose lowermost fastener is latched onto the post of the weight lifting machine, and whose carriage is elevated according to an example embodiment of this invention.

FIG. 6B shows a weight lifting machine 100 being used for resistance training. In FIG. 6B, a user has moved carriage 110 in a direction represented by arrow 120. As carriage 110 is moved in direction 120, fastener 112B' causes the amount of flexible element 101 looping over itself to increase, thereby reducing the total length of flexible element 101 in loop 101C available to suspend resistance element 104. This causes resistance element 104 to elevate. In FIG. 6B, resistance element 104 has been elevated to point 104'. Applying a force in direction 120 to carriage 110 thereby elevating resistance element 104 allows a user of the example embodiment in FIG. 6B to perform resistance training.

Figure 7A:
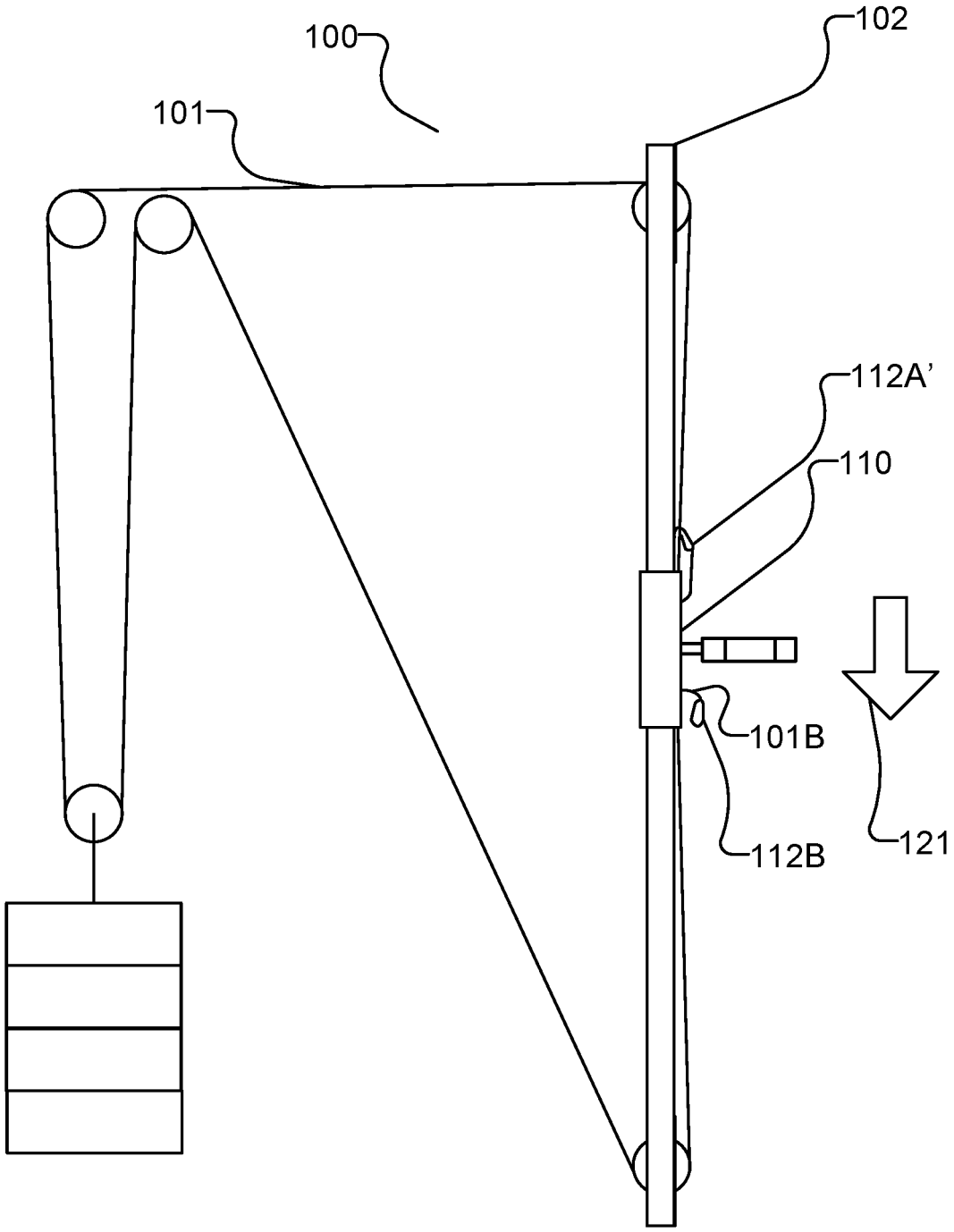
FIG. 7A is a weight lifting machine whose topmost fastener is latched onto the post of the weight lifting machine according to an example embodiment of this invention.

FIG. 7A shows a weight lifting machine 100 being used for resistance training. The user of the weight lifting machine in FIG. 7A has latched fastener 112A' to one of the receivers 103 (not shown in FIG. 7A) on post 102. Fastener 112B acts as a stopper to keep end portion 101B of flexible element 101 coupled with carriage 110. The user is preparing to move carriage 110 in a direction represented by arrow 121.

Figure 7B:
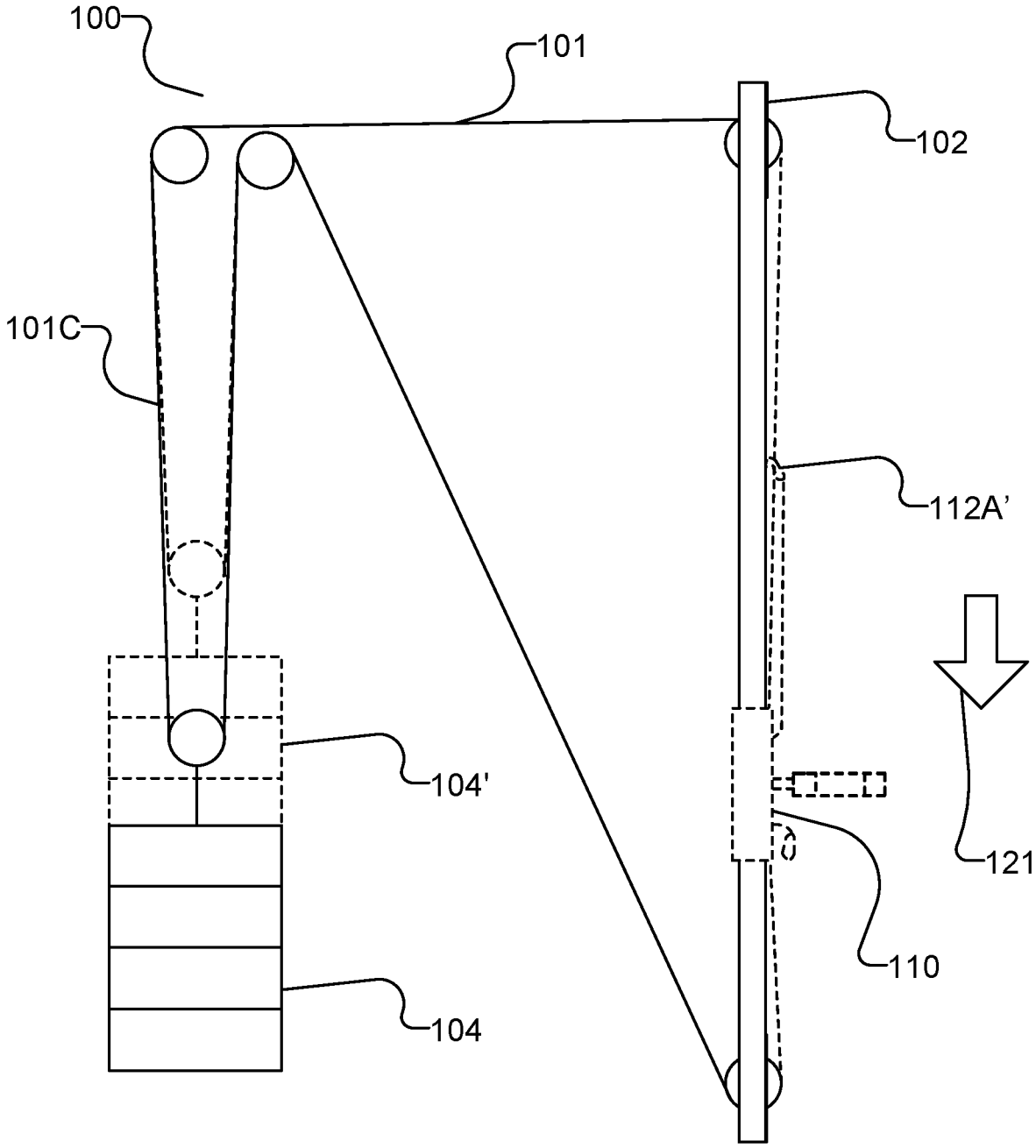
FIG. 7B is a weight lifting machine whose topmost fastener is latched onto the post of the weight lifting machine, and whose carriage is lowered according to an example embodiment of this invention.

FIG. 7B shows a weight lifting machine 100 being used for resistance training. The user has moved carriage 110 in a direction represented by arrow 121. Because fastener 112A' is fastened to one of the receivers 103 on post 102, as the user moves carriage 110 in a direction represented by arrow 121, the total length of flexible element 101 available in loop 101C to suspend resistance element 104 decreases. This elevates resistance element 104. In FIG. 7B, resistance element 104 has been elevated to point 104'. Applying a force in direction 121 to carriage 110 thereby elevating resistance element 104 allows a user of the example embodiment in FIG. 7B to perform resistance training.

Figure 8:
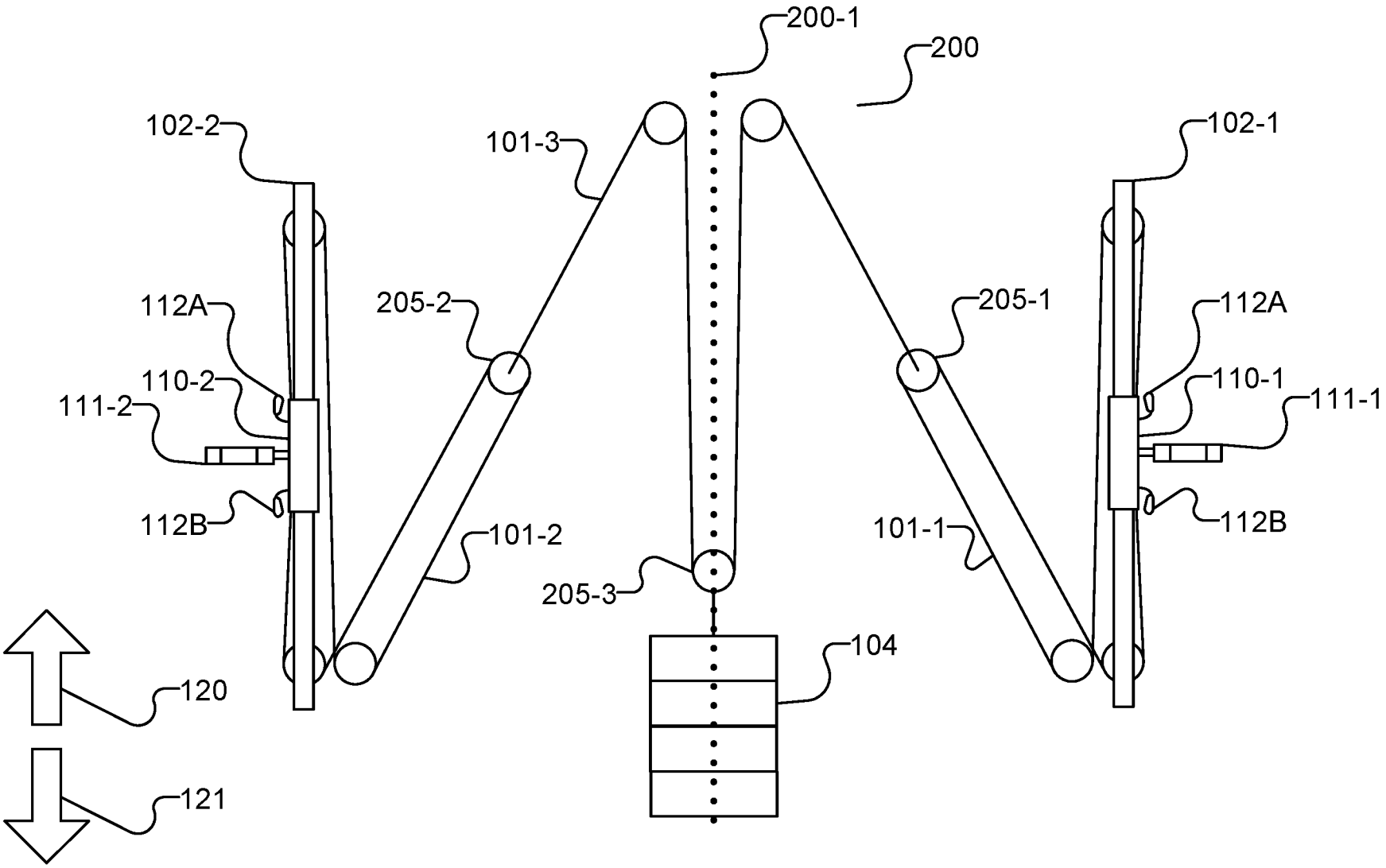
FIG. 8 is a weight lifting machine with two separate carriages attached to the same resistance element according to an example embodiment of this invention.

FIG. 8 shows an exercise machine 200 according to an example embodiment intended for exercising two limbs. Machine 200 has independently movable carriages 110-1 and 110-2. Each of carriages 110-1 and 110-2 is associated with a corresponding operating mechanism as described herein that allows carriages 110-1 and 110-2 to be positioned at desired starting locations and set to provide resistance to motion of carriages 110-1 and 110-2. In this example embodiment, the operating mechanisms associated with carriages 110-1 and 110-2 share the same resistance element 104. The example embodiment shown in FIG. 8 uses the same carriage and fastener mechanism as described in FIGS. 1-7, but employs two of carriages 110 to allow for exercising two limbs at the same time.

Figure 13:
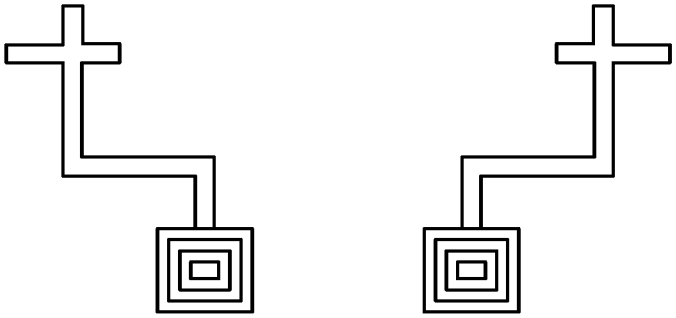
FIGS. 13 to 15 are partial cross-section views of weight lifting machines according to example embodiments of this invention.
Figure 14:
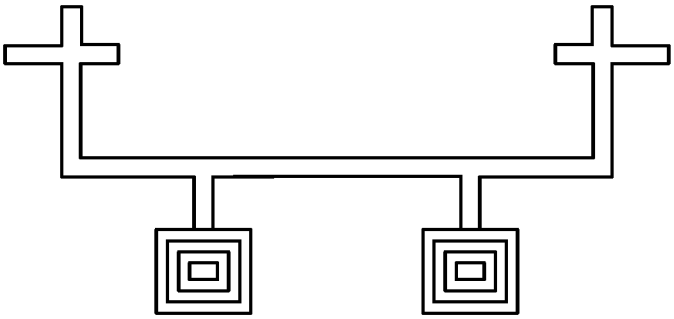
Figure 15:
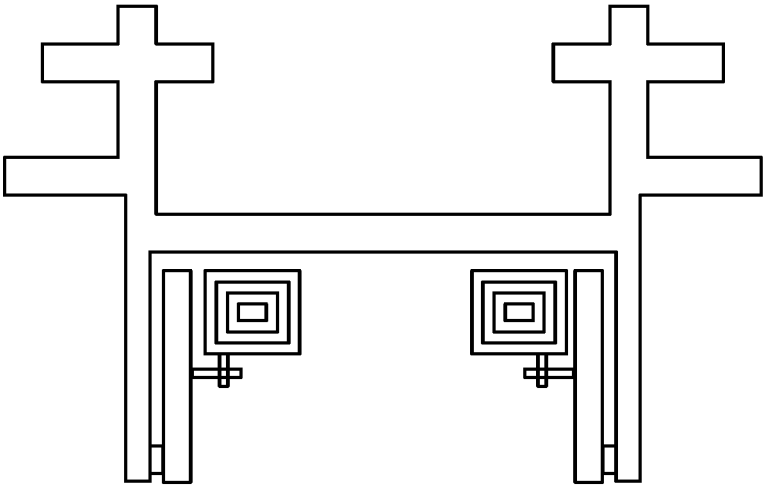

The example embodiment shown in FIG. 8 has been mirrored about plane 200-1 for the sake of clarity in the drawings. In preferred embodiments posts 102-1 and 102-2 are close together such that a user can hold handles 111-1 and 111-2 with both of their hands at the same time. The example embodiment depicted in FIG. 8 operates in an analogous manner to the example embodiments depicted in FIGS. 1-7. For each of carriages 110-1 and 110-2 a user can latch either one of fastener 112A or 112B to a receiver 103 or other anchor point (not shown in FIG. 8). A user can then grab handles 111-1 and 111-2 attached to carriages 110-1 and 110-2 respectively, and move carriages 110-1 and 110-2 in the direction of arrow 120 (if fasteners 112B are fastened), or in the direction of arrow 121 (if fasteners 112A are fastened). Flexible element 101-1 and 101-2 are coupled to first and second central pulley 205-1 and 205-2 respectively. Flexible element 101-3 is coupled to first and second central pulleys 205-1 and 205-2, and is also coupled to a resistance element 104 by pulley 205-3. When a user moves carriages 110-1 and 110-2 while either fasteners 112A or 112B are fastened, the length of flexible element 101-1 and 101-2 forming a loop 101C (depicted in FIG. 1A) decreases. The reduction in the length of loop 101C causes flexible element 101-1 to displace first central pulley 205-1, and causes flexible element 101-2 to displace second central pulley 205-2. The displacement of first and second central pulley 205-1 and 205-2 causes pulley 205-3 to be displaced against the force exerted by resistance element 104. This allows a user to perform resistance training. FIGS. 13 to 15 show alternatives to the embodiment in FIG. 8, wherein handles 111-1, 111-2 are substituted with differently shaped individual and combined handles.

Figure 9:
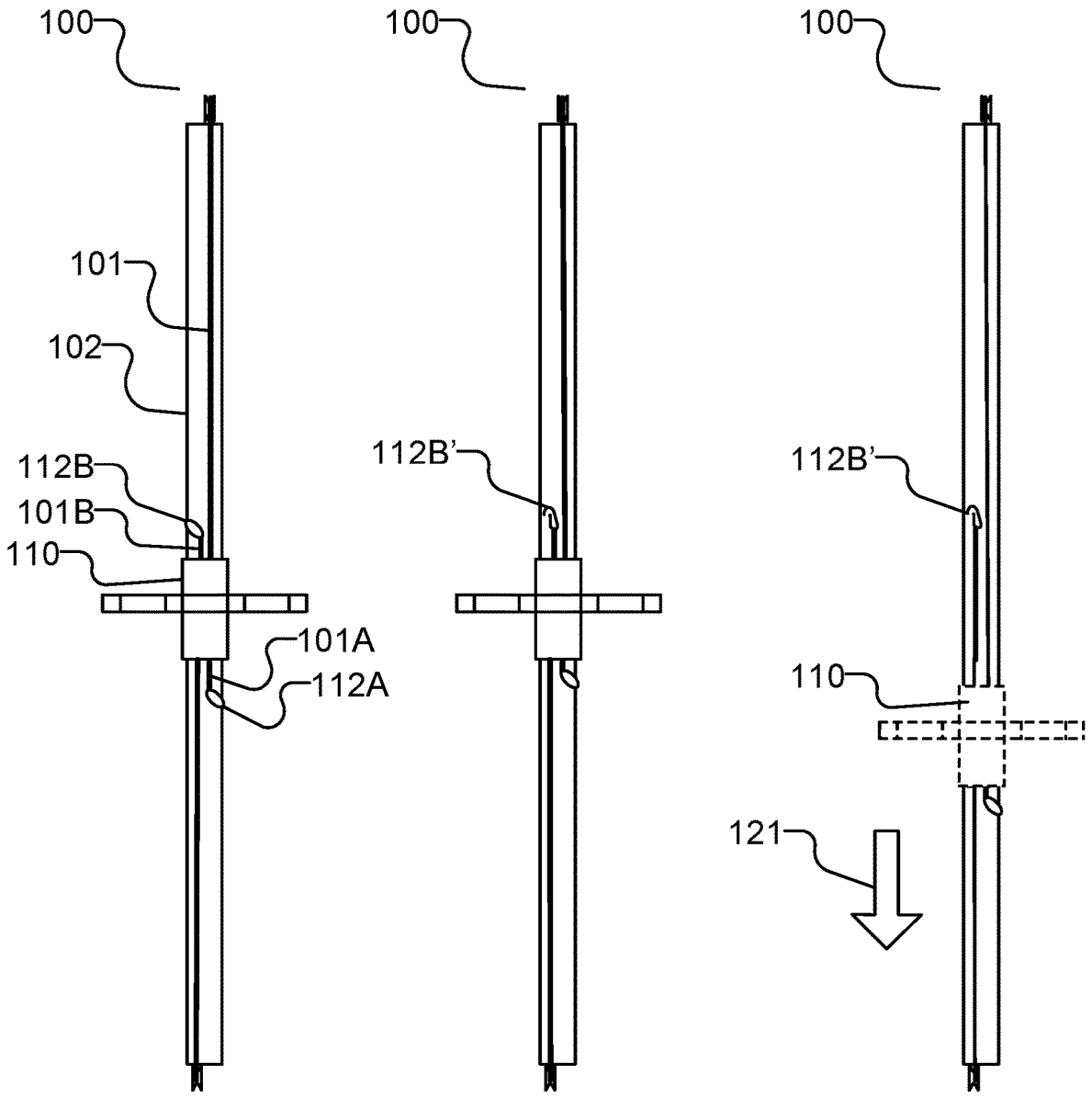
FIG. 9 is a weight lifting machine with the ends of the flexible element threaded underneath the carriage according to an example embodiment of this invention.

FIG. 9 shows an exercise machine 100 according to another example embodiment. Second end portion 101B of flexible element 101 is threaded underneath carriage 110 and terminates at the top of carriage 110. Second end portion 101B is kept in place by fastener 112B resting against carriage 110 and post 102. Fastener 112B acts as a stopper, and post 102 and carriage 110 act as a stop. Similarly, first end portion 101A of flexible element 101 is threaded underneath carriage 110 and terminates at the bottom of carriage 110. First end portion 101A is kept in place by fastener 112A resting against carriage 110 and post 102. Fastener 112A acts as a stopper, and carriage 110 and post 102 act as a stop. The embodiment shown in FIG. 9 otherwise uses the same carriage and fastener mechanism as described in FIGS. 1-7. A fastener (112B' in FIG. 9) is affixed to a stationary point. Carriage 110 is then moved in direction 121. Moving carriage 110 in direction 121 causes a reduction in the length of loop 101C (shown in FIG. 1A) causing pulley 105-1 (shown in FIG. 1A) to be displaced against the force exerted by resistance element 104 (not shown in FIG. 9). This allows a user to perform resistance training. A non-exhaustive list of advantages associated with the exercise machine 100 depicted in FIG. 9 is:

It requires less effort on the part of the user to latch a fastener (112B or 112A) to a point on the post 102; and It places less strain on flexible element 101 as flexible element 101 does not have to double back on itself.

Figure 10:
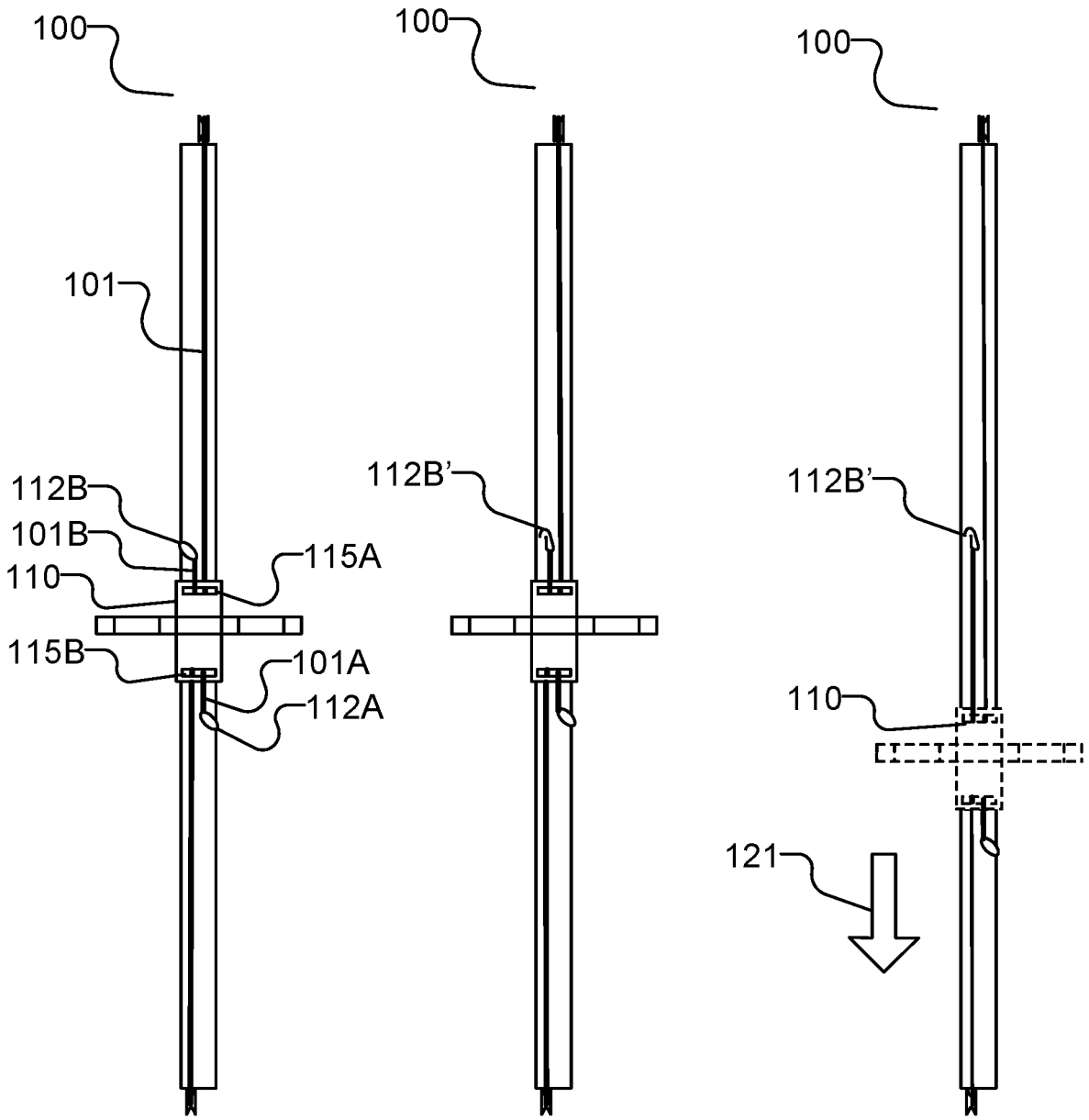
FIG. 10 is a weight lifting machine with the ends of the flexible element threaded underneath the carriage, and protruding through openings in the carriage according to an example embodiment of this invention.

FIG. 10 shows an exercise machine according to another example embodiment. FIG. 10 is analogous to FIG. 9 in that end portions 101A and 101B of flexible element 101 are threaded underneath carriage 110. Unlike FIG. 9 though, second end portion 101B of flexible element 101 is threaded underneath carriage 110 and then through opening 115A. Opening 115A acts as a stop, and fastener 112B acts as a stopper. Similarly, first end portion 101A of flexible element 101 is threaded underneath carriage 110 and then through opening 115B. Opening 115B acts as a stop, and fastener 112A acts as a stopper. The embodiment shown in FIG. 10 otherwise uses the same carriage and fastener mechanism as described in FIGS. 1-7. Fastener 112B' is fixed to an anchor point, and then carriage 110 is moved in a direction 121 to perform resistance training. The advantages of the embodiment shown in FIG. 10 are the same as those articulated in the description of FIG. 9.

Interpretation of Terms

Unless the context clearly requires otherwise, throughout the description and the

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", "travel" and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

While processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times.

In addition, while elements are at times shown as being performed sequentially, they may instead be performed simultaneously or in different sequences. It is therefore intended that the following claims are interpreted to include all such variations as are within their intended scope.

Where a component (e.g. a carriage, a post, a fastener, a receiver etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

Various features are described herein as being present in "some embodiments". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

The invention claimed is:

1. A resistance training machine comprising:

a resistance mechanism, the resistance mechanism comprising:

a carriage coupled to move along a linear guide;

an elongated flexible element having first and second end portions coupled to the carriage;

first and second fasteners that respectively include first and second stoppers attached to the first and second end portions of the flexible element respectively, each of the first and second fasteners adapted to be attached to one of a plurality of anchor points that are fixed relative to the linear guide;

wherein a portion of the flexible element between the first and second end portions forms a loop that follows a path defined by a plurality of guiding elements;

the guiding elements include a displaceable guiding element coupled to a resistance element; and moving the carriage along the linear guide while one of the first and second fasteners is coupled to one of the anchor points causes a length of the portion of the flexible element that forms the loop to be reduced, thereby displacing the displaceable guiding element against a force applied by the resistance element; and a first and second end of the carriage, the first and second end of the carriage being antipodal to each other along the linear guide, the first end portion of the flexible element being threaded through the first end of the carriage, terminating at a point on the second end of the carriage, the second end portion of the flexible element being threaded through the second end of the carriage, terminating at a point on the first end of the carriage.

2. The resistance training machine according to claim 1 wherein the guiding elements comprise a plurality of pulleys, and wherein the first and second end portions of the flexible element double back around first and second rollers carried by the carriage or through a first and a second opening in the carriage, or one attaches to the carriage and the other doubles back around the first or second rollers carried by the carriage or through a first or second carriage opening in the carriage.

3. The resistance training machine according to claim 2 wherein the first and second end portions of the flexible element pass between the carriage and the linear guide and respectively pass outward through the first and second openings to the first and second fasteners.

4. The resistance training machine according to claim 1 wherein the linear guide comprises a post and the carriage is slidably coupled to move along the post, wherein the carriage is formed with a through passage and the post extends through the through passage of the carriage.

5. The resistance training machine according to claim 4 wherein the post comprises:

(a) a plurality of receivers spaced apart along the post wherein the first and second fasteners are attachable to the receivers and each of the receivers defines the plurality of anchor points; and (b) a plurality of pin holes for locking the carriage in place.

6. The resistance training machine according to claim 1 wherein the resistance element comprises a weight that is raised by the reduction of the length of the portion of the flexible element that forms the loop.

7. The resistance training machine according to claim 6 wherein the path of the flexible element includes a bight that extends between two of the guiding elements and passes around the displaceable guiding element.

8. The resistance training machine according to claim 1 comprising a handle attached to move with the carriage.

9. The resistance training machine according to claim 8 wherein the handle is detachably affixed to the carriage.

10. The resistance training machine according to claim 8 wherein the handle comprises:

a base affixed to the carriage that supports an arc shaped segment disposed in a plane orthogonal to the linear guide, a convex side of the arc shaped segment facing the linear guide;

a pair of handgrips affixed to each end of the arc shaped segment, the hand grips of each of the pairs of hand grips arranged at an obtuse angle in the plane orthogonal to the linear guide wherein the obtuse angles face away from the linear guide; and a crossbar affixed to the opposite ends of the arc shaped segment, the crossbar lying in a plane above and parallel to the plane orthogonal to the linear guide in which the arc shaped segment is disposed.

11. The resistance training machine according to claim 10 wherein the crossbar is split into two parts, each of the two parts hingedly affixed to the base such that the two parts hinge downward when not in use, and form a solid bar against which to press against when moving the crossbar upward.

12. The resistance training machine according to claim 8 wherein the handle comprises:

a first segment coupled to the carriage;

a second segment hingedly coupled to the first segment, wherein the second segment is moveable between a first configuration horizontally aligned with the first segment and a second configuration vertically and forwardly displaced with respect to the first segment; and a pair of arms pivotally coupled to the second segment, each arm comprising at least one handgrip.

13. The resistance training machine according to claim 12 comprising an isometric stopper pivotally coupled to the carriage and comprising an engaging portion engageable with corresponding receiving means on the linear guide to prevent further linear displacement of the carriage along the linear guide, wherein the isometric stopper is manually actuatable by an actuating means.

14. The resistance training machine according to claim 12 wherein each of the arms comprises a distal portion and a proximal portion with a pivot point with the second segment therebetween, wherein the arms are in a different parallel plane to the second segment further comprising tension cables attached between opposing one of the distal and proximal portions in a cross-wise manner.

15. The resistance training machine according to claim 1 wherein the carriage further comprises an upper carriage and lower carriage, both carriages coupled to move along the linear guide, wherein the upper carriage is connected to a handle and the lower carriage is connected to a handle, a platform, or nothing.

16. The resistance training machine according to claim 1 wherein the resistance mechanism is a first resistance mechanism and the resistance training machine comprises a second resistance mechanism and the first and second resistance mechanisms share the resistance element.

17. The resistance training machine according to claim 16 wherein the first resistance mechanism comprises the loop forming a first loop to be reduced, the second resistance mechanism forms a second loop to be reduced, the first and second loops to be reduced are respectively coupled to a first central pulley and a second central pulley, the first and second central pulleys are respectively coupled to a first and a second end of a third flexible element, the third flexible element is coupled to the displaceable pulley, and the displaceable pulley is coupled to the resistance element.

18. The resistance training machine according to claim 1 wherein the first end portion of the flexible element passes across the carriage in a direction from the first end of the carriage to the second end of the carriage and the second end portion of the flexible element passes across the carriage in a direction from the second end of the carriage to the first end of the carriage.

19. A resistance training machine comprising:

a carriage;

a handle coupled to the carriage;

a flexible element having a first end in contact with the carriage and a second end in contact with the carriage;

a first fastener and second fastener respectively affixed to the first and second ends of the flexible element;

a resistance element coupled to the flexible element;

a post having a plurality of receivers for the first and second fasteners, the carriage being coupled to the post, the first and second fastener being fastenable to receivers in the post so that moving the carriage causes the resistance element to impose a force against the carriage;

wherein the resistance element comprises a weight that hangs from a pulley that is coupled with the flexible element;

wherein the handle has a detachment point detachably affixing the handle to the carriage;

wherein the first and second fasteners are carabiners;

wherein the post and carriage have a square cross-section;

wherein a wheel and/or ball bearings decrease the friction between the carriage and the post; and a first and second end of the carriage, the first and second end of the carriage being antipodal to each other along the post, the first end portion of the flexible element being threaded through the first end of the carriage, terminating at a point on the second end of the carriage, the second end portion of the flexible element being threaded through the second end of the carriage, terminating at a point on the first end of the carriage.

* * * * *